US010689964B2

(12) United States Patent
Saponja et al.

(10) Patent No.: US 10,689,964 B2
(45) Date of Patent: Jun. 23, 2020

(54) SYSTEMS AND APPARATUSES FOR SEPARATING WELLBORE FLUIDS AND SOLIDS DURING PRODUCTION

(71) Applicant: Heal Systems LP, Calgary (CA)

(72) Inventors: Jeffrey Charles Saponja, Calgary (CA); Robbie Singh Hari, Calgary (CA); Dean Tymko, Calgary (CA)

(73) Assignee: Heal Systems LP, Calgary (CA)

( * ) Notice: Subject to any disclaimer, the term of this patent is extended or adjusted under 35 U.S.C. 154(b) by 0 days.

(21) Appl. No.: 16/002,280

(22) Filed: Jun. 7, 2018

(65) Prior Publication Data

US 2018/0283155 A1 Oct. 4, 2018

Related U.S. Application Data

(63) Continuation of application No. 15/838,938, filed on Dec. 12, 2017, which is a continuation of application (Continued)

(30) Foreign Application Priority Data

Mar. 24, 2014 (CA) ..... 2847341

(51) Int. Cl.
*E21B 43/38* (2006.01)
*E21B 43/12* (2006.01)

(52) U.S. Cl.
CPC ..... *E21B 43/38* (2013.01); *E21B 43/12* (2013.01); *E21B 43/121* (2013.01); *E21B 43/122* (2013.01); *H05K 999/99* (2013.01)

(58) Field of Classification Search
CPC ..... E21B 43/122; E21B 17/18; E21B 43/38; E21B 43/12; E21B 43/121
See application file for complete search history.

(56) References Cited

U.S. PATENT DOCUMENTS 1,554,835 A 9/1925 Barrett
1,674,815 A 6/1928 Barnhart
(Continued)

FOREIGN PATENT DOCUMENTS

CA 2053606 4/1992
CA 2120283 10/1995
(Continued)

OTHER PUBLICATIONS

International Search Report and Written Opinion in PCT/CA2015/000178, dated Jul. 6, 2015.
(Continued)

*Primary Examiner* — Nicole Coy
(74) *Attorney, Agent, or Firm* — Fish & Richardson P.C.

(57) ABSTRACT

There is provided apparatuses, and related systems, for effecting production of oil from a reservoir. A flow diverter is provided and configured to direct flow of reservoir fluids such that gases and solids are separated. A system is also provided, including the flow diverter, and is disposed within a wellbore. A pump is also provided, and disposed in fluid communication with, and downstream from, the flow diverter, for receiving reservoir fluids from which gaseous and solid material have been separated by the separator.

4 Claims, 20 Drawing Sheets

Related U.S. Application Data

No. 15/128,861, filed as application No. PCT/CA2015/000178 on Mar. 24, 2015, which is a continuation-in-part of application No. 14/223,722, filed on Mar. 24, 2014.

(60) Provisional application No. 62/120,196, filed on Feb. 24, 2015, provisional application No. 62/132,249, filed on Mar. 12, 2015, provisional application No. 62/132,880, filed on Mar. 13, 2015.

(56) References Cited

U.S. PATENT DOCUMENTS

| | | | |
|---|---|---|---|
| 1,973,650 | A | 9/1934 | O'Brien |
| 2,525,233 | A | 10/1950 | Miller |
| 2,667,224 | A | 1/1954 | Howard |
| 2,883,940 | A | 4/1959 | Gibson |
| 3,109,490 | A | 11/1963 | Baker |
| 3,182,726 | A | 5/1965 | Stone, Jr. |
| 3,888,311 | A | 6/1975 | Cooke |
| 4,127,168 | A | 11/1978 | Hanson et al. |
| 4,372,393 | A | 2/1983 | Baker |
| 4,383,578 | A | 5/1983 | Baker |
| 4,481,020 | A | 11/1984 | Lee et al. |
| 4,508,167 | A | 4/1985 | Weinberg et al. |
| 4,513,817 | A | 4/1985 | Weinberg |
| 4,676,308 | A | 6/1987 | Chow |
| 4,951,746 | A | 8/1990 | Setterberg, Jr. |
| 5,257,665 | A | 11/1993 | Watkins |
| 5,271,725 | A | 12/1993 | Freet et al. |
| 5,482,117 | A | 1/1996 | Kolpak |
| 5,488,993 | A | 2/1996 | Hershberger |
| 5,535,825 | A | 7/1996 | Hickerson |
| 5,547,021 | A | 8/1996 | Raden |
| 5,662,341 | A | 9/1997 | Ezell et al. |
| 5,899,273 | A | 5/1999 | Jung |
| 6,039,121 | A | 3/2000 | Kisman |
| 6,092,602 | A | 7/2000 | Gano |
| 6,113,675 | A | 9/2000 | Branstetter |
| 6,119,771 | A | 9/2000 | Gano et al. |
| 6,167,970 | B1 | 1/2001 | Stout et al. |
| 6,547,005 | B2 | 4/2003 | Haheim |
| 6,651,740 | B2 | 11/2003 | Kobylinski et al. |
| 6,672,392 | B2 | 1/2004 | Reitz |
| 6,688,395 | B2 | 2/2004 | Maguire et al. |
| 6,854,518 | B1 | 2/2005 | Senyard et al. |
| 6,932,160 | B2 | 8/2005 | Murray |
| 7,063,161 | B2 | 6/2006 | Butler et al. |
| 7,100,695 | B2 | 9/2006 | Reitz |
| 7,104,321 | B2 | 9/2006 | Carruth |
| 7,174,959 | B2 | 2/2007 | Pratt |
| 7,571,777 | B2 | 8/2009 | Wylie et al. |
| 7,717,182 | B2 | 5/2010 | Butler et al. |
| 7,776,085 | B2 | 8/2010 | Bernero et al. |
| 7,909,092 | B2 | 3/2011 | Cobb |
| 8,006,751 | B2 | 8/2011 | Lambert et al. |
| 8,006,756 | B2 | 8/2011 | Mazzanti |
| 8,051,907 | B2 | 11/2011 | Cobb |
| 8,985,221 | B2 | 3/2015 | Mazzanti |
| 9,022,106 | B1 | 5/2015 | McCoy |
| 2005/0081718 | A1 | 4/2005 | Carruth |
| 2006/0113082 | A1 | 6/2006 | Moffett et al. |
| 2007/0246227 | A1 | 10/2007 | Ezell et al. |
| 2008/0271890 | A1 | 11/2008 | Smith et al. |
| 2009/0194293 | A1 | 8/2009 | Stephenson et al. |
| 2009/0200041 | A1 | 8/2009 | Watson |
| 2009/0229821 | A1 | 9/2009 | Misselbrook et al. |
| 2010/0108323 | A1 | 5/2010 | Wilkin |
| 2010/0126727 | A1 | 5/2010 | Vinegar et al. |
| 2010/0258306 | A1 | 10/2010 | Camilleri et al. |
| 2010/0319926 | A1 | 12/2010 | Reid |
| 2011/0024121 | A1 | 2/2011 | Skeates et al. |
| 2011/0100624 | A1 | 5/2011 | Ford |
| 2011/0114320 | A1 | 5/2011 | Sponchia et al. |
| 2011/0214880 | A1 | 9/2011 | Rogers |
| 2011/0214883 | A1 | 9/2011 | Patel |
| 2011/0278017 | A1 | 11/2011 | Themig et al. |
| 2012/0006543 | A1 | 1/2012 | Cox |
| 2012/0073827 | A1 | 3/2012 | Kenyon et al. |
| 2012/0125631 | A1 | 5/2012 | Entchev et al. |
| 2012/0125632 | A1 | 5/2012 | Blair et al. |
| 2012/0178653 | A1 | 7/2012 | McClung |
| 2012/0227984 | A1 | 9/2012 | Thomson et al. |
| 2012/0234551 | A1 | 9/2012 | Keller et al. |
| 2012/0325499 | A1 | 12/2012 | Moffitt |
| 2013/0014956 | A1 | 1/2013 | Hughes et al. |
| 2013/0025868 | A1 | 1/2013 | Smith et al. |
| 2013/0032341 | A1 | 2/2013 | Raglin |
| 2013/0043020 | A1* | 2/2013 | Eriksen ..... E21B 7/20 166/142 |
| 2013/0068454 | A1 | 3/2013 | Armistead |
| 2013/0081827 | A1 | 4/2013 | Etzel |
| 2013/0133883 | A1 | 5/2013 | Hill, Jr. |
| 2013/0153203 | A1 | 6/2013 | Lauderdale |
| 2014/0020775 | A1 | 1/2014 | Iboldi et al. |
| 2015/0075772 | A1* | 3/2015 | Saponja ..... E21B 23/00 166/115 |
| 2015/0247390 | A1 | 9/2015 | Mazzanti |

FOREIGN PATENT DOCUMENTS

| | | |
|---|---|---|
| CA | 2781599 | 6/2011 |
| CA | 2823495 | 6/2013 |
| CN | 102369337 | 3/2012 |
| CN | 102859113 | 1/2013 |
| CN | 103180544 | 6/2013 |
| EP | 0 802 303 | 10/1997 |
| GB | 2450565 | 12/2008 |
| RU | 2312985 | 12/2007 |
| WO | WO 2013/015826 | 1/2013 |
| WO | WO 2013/016097 | 1/2013 |

OTHER PUBLICATIONS

Office Action for Colombian Application No. NC2016/0003228, dated Nov. 8, 2016 with English Translation.

Riza et al., "A Pragmatic Approach to Understanding Liquid Loading in Gas Wells", *SPE Production & Operations*, 2015.

Office Action issued in Colombian Patent Application No. NC2016/0003228 dated Nov. 23, 2017 (With English Translation.

U.S. Office Action issued for U.S. Appl. No. 14/223,722 dated Oct. 31, 2016.

McCoy, "Packer-Type Gas Separator with seating Nipple,", 8th Annual Sucker Rod Pumping Workshop, Renaissance Hotel, Oklahoma City, Oklahoma, Sep. 25-28, 2012 (35 pages).

Office Action issued in Chinese Application No. 2015/80026265.1, dated May 15, 2018 (English Translation).

Extended European Search Report in 15768393.9, dated Oct. 4, 2017.

Office Action issued in Colombian Patent Application No. NC2016/0003228, dated Feb. 21, 2018 (English Translation).

Office Action issued in Colombian Patent Application No. NC2016/0003228, dated Jan. 4, 2017 (English Translation).

Office Action issued in EP 15768393.9 dated Jul. 23, 2018 (5 pages).

International Search Report and Written Opinion for PCT/CA2015/000177, dated Jun. 15, 2015.

International Search Report and Written Opinion issued in PCT/CA2014/000695, dated Dec. 19, 2014.

Jadid et al., "The Pressure's on: Innovation in Gas Lift", Oilfield Review, 18(4): 44-53, Winter 2006/2007.

McCoy, J.N., et al., "Optimizing Downhole Packer-Type Separators", 2013, Presented at the Annual Southwestern Petroleum Short Course.

National Oilwell Varco, ESP BY-PASS, available online: https://www.nov.com/Downhole/Intervention_and_Completion_Tools/Completion_Equipment/ESP_Bypass_Systems/ESP By-Pass.aspx; Accessed on Feb. 15, 2013.

Office Action issued in U.S. Appl. No. 14/026,170, dated Jun. 29, 2016.

(56) References Cited

OTHER PUBLICATIONS

Office Action issued in U.S. Appl. No. 14/026,170, dated Dec. 4, 2015.
Office Communication issued in European Application No. 14844941.6, dated Apr. 20, 2016.
Schlumberger, Quantum anchor latch assembly (2009).
Seal assemblies (locator, anchor, latch), available online at: http:www.wipertrip.com/completion/design/571-seal-assemblies-locator-anchor-latch.html; Accessed on Feb. 7, 2013.
Suretech completions, Packer seal bore assemblies (2013).
Wikipedia article on hydraulic fracturing, Accessed on Apr. 29, 2013.
Office Action issued in Australian Patent Application No. 2015234631 dated Aug. 21, 2018 (7 pages).
Office Action issued in Eurasian Patent Application No. 201691895/31 dated Jul. 18, 2018,with English Translation (7 pages).

* cited by examiner

SYSTEMS AND APPARATUSES FOR SEPARATING WELLBORE FLUIDS AND SOLIDS DURING PRODUCTION

CROSS-REFERENCE TO RELATED APPLICATIONS

This application is a continuation of and claims priority under 35 U.S.C. § 120 from U.S. application Ser. No. 15/838,938, filed on Dec. 12, 2017, which is a continuation of Ser. No. 15/128,861, filed on Sep. 23, 2016, which is a National Stage of International Application No. PCT Application No. PCT/CA2015/000178, filed on Mar. 24, 2015, which claims priority to Canadian Patent No. 2847341, filed on Mar. 24, 2014, which is a Continuation-In-Part U.S. application Ser. No. 14/223,722, filed on Mar. 24, 2014, and claims priority from U.S. Application No. 62/120,196, filed on Feb. 24, 2015, U.S. Application No. 62/132,249, filed on Mar. 12, 2015, and U.S. Application No. 62/132,880, filed on Mar. 13, 2015. The entire contents of each of these priority applications are incorporated herein by reference.

TECHNICAL FIELD

The present disclosure relates to artificial lift systems, and related apparatuses, for use in producing hydrocarbon-bearing reservoirs.

BACKGROUND

Gas interference is a problem encountered while producing wells, especially wells with horizontal sections. Gas interference results in downhole pumps becoming gas locked and/or low pump efficiencies. Gas interference reduces the operating life of the pump. Downhole packer-type gas anchors or separators are provided to remedy gas lock. However, existing packer-type gas anchors occupy relatively significant amounts of space within a wellbore, rendering efficient separations difficult or expensive.

SUMMARY

In one aspect, there is provided a flow diverter for conducting at least reservoir fluid within a wellbore fluid conductor disposed within a wellbore, the wellbore fluid conductor including a co-operating fluid conductor, wherein the flow diverter comprises: a first inlet port for receiving at least reservoir fluids; a plurality of first outlet ports; a plurality of first fluid passage branches, each one of the first fluid passage branches, independently, extending from a respective at least one of the first outlet ports and disposed in fluid communication with the first inlet port such that the plurality of fluid outlet ports are fluidly coupled to the first inlet port by the first fluid passage branches; a plurality of second inlet ports, positioned relative to the first outlet ports such that, when the flow diverter is disposed within the wellbore and oriented for receiving at least reservoir fluids via the first inlet port, each one of the second inlet ports, independently, is disposed downhole relative to the first outlet ports; a second outlet port; a plurality of second fluid passage branches, each one of the second fluid passage branches, independently, extending from a respective second inlet port and disposed in fluid communication with the second outlet port such that the plurality of second inlet ports is fluidly coupled to the second outlet port by the plurality of second fluid passage branches; and a co-operating surface configured for co-operating with the co-operating fluid conductor, while the flow diverter is disposed within the wellbore and oriented for receiving at least reservoir fluids via the first inlet port, to define an intermediate fluid passage therebetween for effecting fluid communication between the first outlet ports and the second inlet ports.

In another aspect, there is provided a flow diverter for conducting at least reservoir fluid within a wellbore fluid conductor disposed within a wellbore, the wellbore fluid conductor including a separator co-operating fluid conductor, wherein the flow diverter comprises: a first inlet port for receiving at least reservoir fluids; a first outlet port; a reservoir fluid-conducting passage extending between the first inlet port and the first outlet port; a second inlet port, positioned relative to the first outlet port such that, when the flow diverter is disposed within the wellbore and oriented for receiving at least reservoir fluids via the first inlet port, the second inlet port is disposed downhole relative to the first outlet port; a second outlet port; a gas-depleted fluid conducting passage extending between the second inlet port and the second outlet port; and a co-operating surface configured for co-operating with the separator co-operating fluid conductor, while the flow diverter is disposed within the wellbore and oriented for receiving at least reservoir fluids via the first inlet port, to define an intermediate fluid passage therebetween for effecting fluid communication between the first outlet port and the second inlet port. wherein the first outlet port is oriented such that, while the flow diverter is disposed within a wellbore section, a ray, that is disposed along the axis of the first outlet port, is disposed in an uphole direction at an acute angle of less than 30 degrees relative to the axis of the wellbore section within which the flow diverter is disposed.

In one aspect, there is provided a system for producing oil from a reservoir comprising a flow diverter disposed within a wellbore and oriented for receiving at least reservoir fluids, the flow diverter being configured for conducting at least reservoir fluid within a wellbore fluid conductor disposed within a wellbore, the wellbore fluid conductor including a separator co-operating fluid conductor, the separator co-operating fluid conductor including a downhole wellbore fluid passage for receiving reservoir fluids from the reservoir and for conducting at least reservoir fluids, wherein the flow diverter comprises: a first inlet port for receiving at least reservoir fluids from the downhole wellbore fluid passage; a first outlet port; a reservoir fluid-conducting passage extending between the first inlet port and the first outlet port; a second inlet port, positioned relative to the first outlet port such that, when the flow diverter is disposed within the wellbore and oriented for receiving at least reservoir fluids via the first inlet port, the second inlet port is disposed downhole relative to the first outlet port; a second outlet port; a gas-depleted fluid conducting passage extending between the second inlet port and the second outlet port; and a co-operating surface configured for co-operating with the separator co-operating fluid conductor, while the flow diverter is disposed within the wellbore and oriented for receiving at least reservoir fluids via the first inlet port, to define an intermediate fluid passage therebetween for effecting fluid communication between the first outlet port and the second inlet port; wherein the first outlet port is oriented such that a ray, that is disposed along the axis of the first outlet port, is disposed in an uphole direction at an acute angle of less than 30 degrees relative to the axis of the wellbore section within which the flow diverter is disposed.

In another aspect, there is provided a flow diverter for conducting at least reservoir fluid within a wellbore fluid conductor disposed within a wellbore, the wellbore fluid conductor including a separator co-operating fluid conductor, wherein the flow diverter comprises: a first inlet port for receiving at least reservoir fluids; a first outlet port; a reservoir fluid-conducting passage extending between the first inlet port and the first outlet port; a second inlet port, positioned relative to the first outlet port such that, when the flow diverter is disposed within the wellbore and oriented for receiving at least reservoir fluids via the first inlet port, the second inlet port is disposed downhole relative to the first outlet port; a second outlet port; a gas-depleted fluid conducting passage extending between the second inlet port and the second outlet port; and a co-operating surface configured for co-operating with the separator co-operating fluid conductor, while the flow diverter is disposed within the wellbore and oriented for receiving at least reservoir fluids via the first inlet port, to define an intermediate fluid passage therebetween for effecting fluid communication between the first outlet port and the second inlet port; and a shroud co-operatively disposed relative to the second inlet port such that, while the flow diverter is disposed within the wellbore and oriented for receiving at least reservoir fluids via the first inlet port, the shroud projects below the second inlet port; wherein the co-operating surface includes a surface of the shroud.

In another aspect, there is provided a system for producing oil from a reservoir comprising: a downhole pump disposed within a wellbore for effecting flow of oil from the reservoir to the surface; a wellbore fluid conductor disposed within the wellbore and including a separator co-operating fluid conductor; a flow diverter, disposed within the wellbore fluid conductor, comprising: a first inlet port for receiving at least reservoir fluids; a first outlet port; a reservoir fluid-conducting passage extending between the first inlet port and the first outlet port; a second inlet port disposed downhole relative to the first outlet port; a second outlet port fluidly coupled to the suction of the downhole pump; a gas-depleted fluid conducting passage extending between the second inlet port and the second outlet port; and a co-operating surface configured co-operating with the separator co-operating fluid conductor to define an intermediate fluid passage therebetween for effecting fluid communication between the first outlet port and the second inlet port; and a shroud projecting below the second inlet port; wherein the co-operating surface includes a surface of the shroud; and wherein the distance by which the shroud projects below the second inlet port is selected based on at least: (i) optimization of separation efficiency of gaseous material from reservoir fluid prior to receiving of the reservoir fluid by the second inlet ports, and (ii) optimization of separation efficiency of solid material from reservoir fluid, prior to receiving of the reservoir fluid by the second inlet ports.

In another aspect, there is provided a flow diverter for conducting at least reservoir fluid within a wellbore fluid conductor disposed within a wellbore, the wellbore fluid conductor including a separator co-operating fluid conductor, wherein the flow diverter comprises: a first inlet port for receiving at least reservoir fluids; a first outlet port; a reservoir fluid-conducting passage extending between the first inlet port and the first outlet port; a second inlet port disposed downhole relative to the first outlet port; a second outlet port fluidly coupled to the suction of the downhole pump; a gas-depleted fluid conducting passage extending between the second inlet port and the second outlet port; and a co-operating surface configured co-operating with the separator co-operating fluid conductor to define an intermediate fluid passage therebetween for effecting fluid communication between the first outlet port and the second inlet port; wherein the first outlet port is radially tangential to the axial plane of the wellbore fluid conductor so as to effect a cyclonic flow condition in the reservoir fluid being discharged through one or more of the outlet ports, and wherein the disposed radially tangential angle of the first outlet port is less than 15 degrees as measured axially along the diverter.

In another aspect, there is provided a flow diverter for conducting at least reservoir fluid within a wellbore fluid conductor disposed within a wellbore, the wellbore fluid conductor including a separator co-operating fluid conductor, wherein the flow diverter comprises: a first inlet port for receiving at least reservoir fluids; a first outlet port; a reservoir fluid-conducting passage extending between the first inlet port and the first outlet port; a second inlet port disposed downhole relative to the first outlet port; a second outlet port fluidly coupled to the suction of the downhole pump; a gas-depleted fluid conducting passage extending between the second inlet port and the second outlet port; and a co-operating surface configured co-operating with the separator co-operating fluid conductor to define an intermediate fluid passage therebetween for effecting fluid communication between the first outlet port and the second inlet port; wherein the first outlet port is positioned such that, while the flow diverter is disposed within the wellbore fluid conductor, the first outlet port is: (a) radially offset from the longitudinal axis of the wellbore fluid conductor, and (b) oriented in a direction having a tangential component relative to the longitudinal axis of the wellbore fluid conductor.

In another aspect, there is provided a system for processing at least reservoir fluids within a wellbore that is disposed within an oil reservoir, the system comprising: a separator co-operating fluid conductor disposed within the wellbore, and including a downhole wellbore fluid passage for receiving reservoir fluids from the reservoir and for conducting at least reservoir fluids; a separator including: a first inlet port disposed in fluid communication with the downhole wellbore fluid passage for receiving at least reservoir fluids from the downhole wellbore fluid passage; a first outlet port; a reservoir fluid-conducting passage extending between the first inlet port and the first outlet port; a second inlet port disposed downhole relative to the first outlet port; a second outlet port a gas-depleted fluid conducting passage extending between the second inlet port and the second outlet port; and a co-operating surface portion co-operating with the separator co-operating fluid conductor to define an intermediate fluid passage therebetween for effecting fluid communication between the first outlet port and the second inlet port; a sealed interface, defined by a sealingly, or substantially sealingly, disposition of the separator relative to the separator co-operating fluid conductor, wherein the sealing disposition is effected downhole relative to the second inlet port, with effect that fluid flow, across the sealed interface, is prevented, or substantially prevented; wherein the sealed interface is disposed within a wellbore section that is disposed at an angle of greater than 60 degrees relative to the vertical.

In another aspect, there is provided a process for producing oil from a reservoir, comprising: receiving reservoir fluids within the wellbore from the reservoir; supplying gaseous material into the wellbore; admixing the received reservoir fluids with the supplied gaseous material to generate a density-reduced fluid including a liquid material constituent and a gaseous material constituent; conducting the density-reduced fluid to a separator; effecting separation of at least a fraction of the gaseous material constituent from the density-reduced fluid to produce a gaseous material-depleted fluid; conducting the gaseous material-depleted fluid to a downhole pump disposed within the wellbore; and driving the gaseous material-depleted fluid to the surface with the downhole pump; wherein the density-reduced fluid being conducted to the separator is disposed within the annular flow regime or the mist flow regime.

In another aspect, there is provided a process for producing oil from a reservoir, comprising:

receiving reservoir fluids within the wellbore from the reservoir;

supplying gaseous material into the wellbore;

admixing the received reservoir fluids with the supplied gaseous material to generate a density-reduced fluid including a liquid material constituent and a gaseous material constituent;

conducting the density-reduced fluid to a separator;

effecting separation of at least a fraction of the gaseous material constituent from the density-reduced fluid to produce a gaseous material-depleted fluid;

conducting the gaseous material-depleted fluid to a downhole pump disposed within the wellbore; and driving the gaseous material-depleted fluid to the surface with the downhole pump;

wherein the derivative of the bottomhole pressure with respect to the volumetric flow of the gaseous material, being supplied to the wellbore and admixed with the received reservoir fluid is greater than zero (0).

In another aspect, there is provided the concept of operating a process, for producing oil from a reservoir, over an operating time duration of at least 30 days, the process comprising:

receiving reservoir fluids within the wellbore from the reservoir;

supplying gaseous material into the wellbore;

admixing the received reservoir fluids with the supplied gaseous material to generate a density-reduced fluid including a liquid material constituent and a gaseous material constituent;

conducting the density-reduced fluid to a separator;

effecting separation of at least a fraction of the gaseous material constituent from the density-reduced fluid to produce a gaseous material-depleted fluid;

conducting the gaseous material-depleted fluid to a downhole pump disposed within the wellbore; and driving the gaseous material-depleted fluid to the surface with the downhole pump;

wherein, over an operative fraction of the operating time duration, the derivative of the bottomhole pressure with respect to the volumetric flow of the gaseous material, being supplied to the wellbore and admixed with the received reservoir fluid, is greater than zero (0), and wherein the operative fraction is at least 50% of the cumulative period of time of operation.

In another aspect, there is provided a process for producing formation fluid from a reservoir, comprising:

receiving formation fluids within the wellbore from the subterranean formation;

supplying a gaseous material input into the wellbore;

admixing the received reservoir fluids with the supplied gaseous material input to generate a density-reduced formation fluid including a liquid material constituent and a gaseous material constituent;

conducting the density-reduced formation fluid at least partially uphole through the wellbore;

effecting separation of at least a gas-rich separated fluid fraction from the density-reduced formation fluid;

recycling at least a fraction of the gas-rich separated fluid fraction as at least a fraction of the gaseous material input;

wherein the supplying a gaseous material input into the wellbore includes:

conducting the gaseous material input through a choke such that the gaseous material input is disposed in a choked flow condition when the admixing is effected; and prior to the conducting the gaseous material input through the choke, modulating the pressure of the gaseous material input when the pressure of the gaseous material input, upstream of the choke, deviates from a predetermined pressure.

In another aspect, there is provided a process for producing formation fluid from a reservoir, comprising:

receiving formation fluids within the wellbore from the subterranean formation;

supplying a gaseous material input into the wellbore;

admixing the received reservoir fluids with the supplied gaseous material input to generate a density-reduced formation fluid including a liquid material constituent and a gaseous material constituent;

conducting the density-reduced formation fluid at least partially uphole through the wellbore;

effecting separation of at least a gas-rich separated fluid fraction from the density-reduced formation fluid;

recycling at least a fraction of the gas-rich separated fluid fraction as at least a fraction of the gaseous material input; and modulating a fluid characteristic of the gas-rich separated fluid fraction such that the density-reduced formation fluid being conducted uphole, within the wellbore, is disposed within a predetermined flow regime.

In another aspect, there is provided a process for producing formation fluid from a reservoir, comprising:

receiving formation fluids within the wellbore from the subterranean formation;

supplying a gaseous material input into the wellbore;

admixing the received reservoir fluids with the supplied gaseous material input to generate a density-reduced formation fluid including a liquid material constituent and a gaseous material constituent;

conducting the density-reduced formation fluid at least partially uphole through the wellbore;

effecting separation of at least a gas-rich separated fluid fraction from the density-reduced formation fluid;

recycling at least a fraction of the gas-rich separated fluid fraction as at least a fraction of the gaseous material input; and controlling a fluid characteristic of the gas-rich separated fluid fraction such that the density-reduced formation fluid being conducted uphole, within the wellbore, is disposed within a predetermined flow regime.

In another aspect, there is provided a process for producing formation fluid from a reservoir, comprising:

receiving formation fluids within the wellbore from the subterranean formation;

supplying a gaseous material input into the wellbore;

admixing the received reservoir fluids with the supplied gaseous material input to generate a density-reduced formation fluid including a liquid material constituent and a gaseous material constituent;

conducting the density-reduced formation fluid at least partially uphole through the wellbore;

effecting separation of at least a gas-rich separated fluid fraction from the density-reduced formation fluid;

recycling at least a fraction of the gas-rich separated fluid fraction as at least a fraction of the gaseous material input; and controlling a fluid characteristic of the gas-rich separated fluid fraction such that the derivative of the bottomhole pressure with respect to the volumetric flow of the gaseous material input, being supplied to the wellbore and admixed with the received reservoir fluid, is greater than zero (0).

In another aspect, there is provided a process for producing formation fluid from a reservoir, comprising:

receiving formation fluids within the wellbore from the subterranean formation;

supplying a gaseous material input into the wellbore;

while the supplying of a gaseous material input into the wellbore is being effected, controlling a fluid characteristic of the gaseous material input such that the derivative of the bottomhole pressure with respect to the volumetric flow of the gaseous material input, being supplied to the wellbore and admixed with the received reservoir fluid, is greater than zero (0);

admixing the received reservoir fluids with the supplied gaseous material input to generate a density-reduced formation fluid including a liquid material constituent and a gaseous material constituent; and conducting the density-reduced formation fluid at least partially uphole through the wellbore;

effecting separation of at least a fraction of the gaseous material constituent from the density-reduced fluid to produce a gaseous material-depleted fluid;

conducting the gaseous material-depleted fluid to a downhole pump disposed within the wellbore; and driving the gaseous material-depleted fluid to the surface with the downhole pump.

In another aspect, there is provided a process for producing formation fluid from a reservoir, comprising:

receiving formation fluids within the wellbore from the subterranean formation;

supplying a gaseous material input into the wellbore;

while the supplying of a gaseous material input into the wellbore is being effected, controlling a fluid characteristic of the gaseous material input such that the density-reduced formation fluid being conducted uphole, within the wellbore, is disposed within a mist flow regime;

admixing the received reservoir fluids with the supplied gaseous material input to generate a density-reduced formation fluid including a liquid material constituent and a gaseous material constituent; and conducting the density-reduced formation fluid at least partially uphole through the wellbore;

effecting separation of at least a fraction of the gaseous material constituent from the density-reduced fluid to produce a gaseous material-depleted fluid;

conducting the gaseous material-depleted fluid to a downhole pump disposed within the wellbore; and driving the gaseous material-depleted fluid to the surface with the downhole pump In another aspect, there is provided a process for producing formation fluid from a reservoir, comprising:

receiving formation fluids within the wellbore from the subterranean formation;

supplying a gaseous material input into the wellbore;

while the supplying of a gaseous material input into the wellbore is being effected, controlling a fluid characteristic of the gaseous material input such that the density-reduced formation fluid being conducted uphole, within the wellbore, is disposed within the annular flow regime;

admixing the received reservoir fluids with the supplied gaseous material input to generate a density-reduced formation fluid including a liquid material constituent and a gaseous material constituent;

conducting the density-reduced formation fluid at least partially uphole through the wellbore;

effecting separation of at least a fraction of the gaseous material constituent from the density-reduced fluid to produce a gaseous material-depleted fluid;

conducting the gaseous material-depleted fluid to a downhole pump disposed within the wellbore; and driving the gaseous material-depleted fluid to the surface with the downhole pump. The details of one or more embodiments of the invention are set forth in the accompanying drawings and the description below. Other features, objects, and advantages of the invention will be apparent from the description and drawings, and from the claims.

DESCRIPTION OF DRAWINGS

The process of the preferred embodiments of the invention will now be described with the following accompanying drawing:

FIG. 7A to 7E illustrate another embodiment of the flow diverter, wherein FIG. 7A is a top plan view, FIG. 7B is a sectional elevation view taken along lines A-A in FIG. 7A, FIG. 7C is a sectional elevation view taken along lines C-C in FIG. 7A, FIG. 7D is a sectional plan view taken along lines D-D in FIG. 7B, FIG. 7E is a bottom plan view.

DETAILED DESCRIPTION

Figure 1:
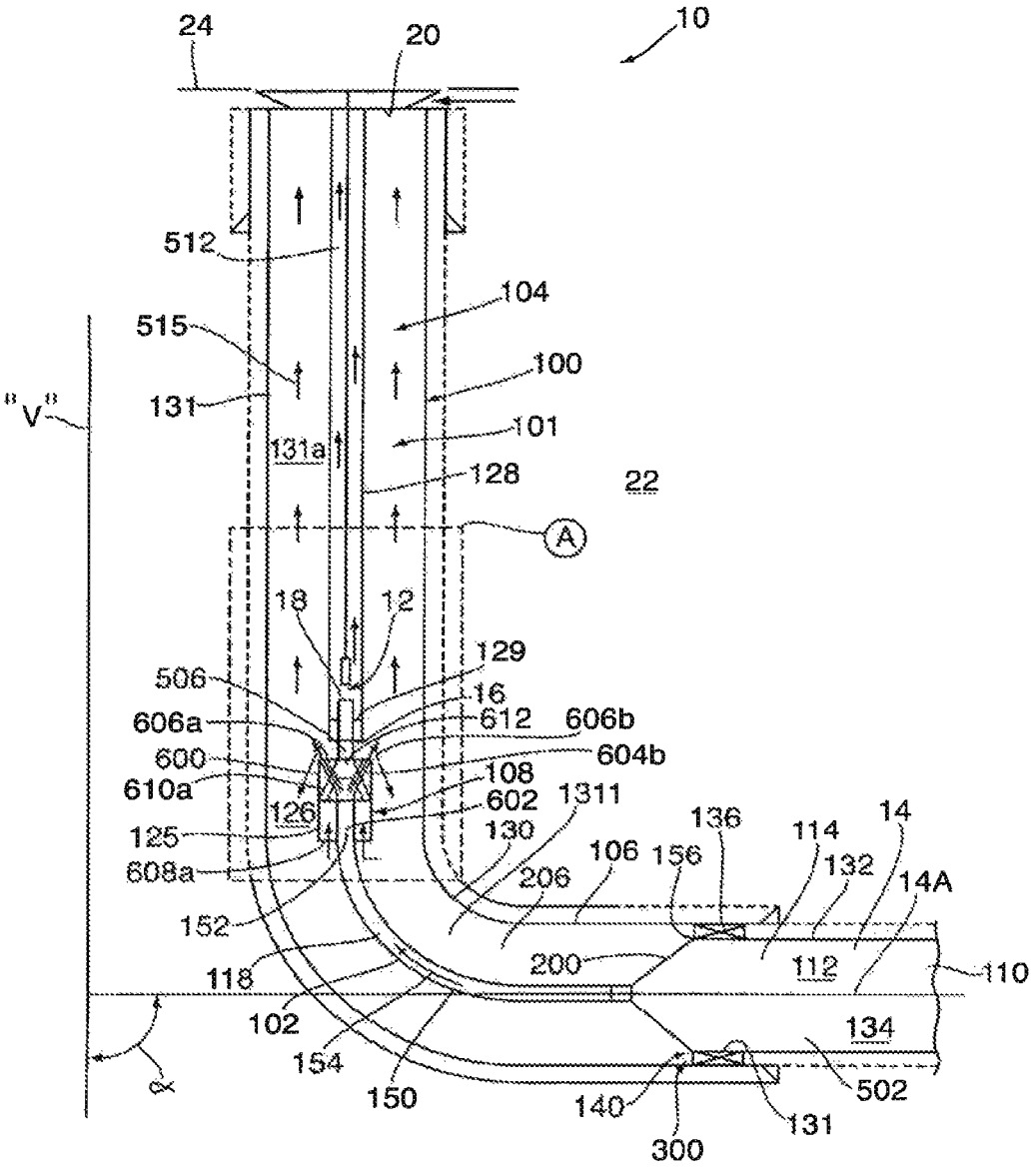
FIG. 1 is a schematic illustration of an embodiment of a system of the present disclosure using a downhole pump.

As used herein, the terms "up", "upward", "upper", or "uphole", mean, relativistically, in closer proximity to the surface and further away from the bottom of the wellbore, when measured along the longitudinal axis of the wellbore. The terms "down", "downward", "lower", or "downhole" mean, relativistically, further away from the surface and in closer proximity to the bottom of the wellbore, when measured along the longitudinal axis of the wellbore.

There is provided systems, with associated apparatuses, for producing hydrocarbons from an oil reservoir, such as an oil reservoir, when reservoir pressure within the oil reservoir is insufficient to conduct hydrocarbons to the surface through a wellbore 14.

The wellbore 14 can be straight, curved, or branched. The wellbore can have various wellbore portions. A wellbore portion is an axial length of a wellbore. A wellbore portion can be characterized as "vertical" or "horizontal" even though the actual axial orientation can vary from true vertical or true horizontal, and even though the axial path can tend to "corkscrew" or otherwise vary. The term "horizontal", when used to describe a wellbore portion, refers to a horizontal or highly deviated wellbore portion as understood in the art, such as, for example, a wellbore portion having a longitudinal axis that is between 70 and 110 degrees from vertical The fluid productive portion of the wellbore may be completed either as a cased-hole completion or an open-hole completion.

Well completion is the process of preparing the well for injection of fluids into the hydrocarbon-containing reservoir, or for production of reservoir fluid from the reservoir, such as oil. This may involve the provision of a variety of components and systems to facilitate the injection and/or production of fluids, including components or systems to segregate oil reservoir zones along sections of the wellbore.

"Reservoir fluid" is fluid that is contained within an oil reservoir. Reservoir fluid may be liquid material, gaseous material, or a mixture of liquid material and gaseous material. In some embodiments, for example, the reservoir fluid includes water and hydrocarbons, such as oil, natural gas condensates, or any combination thereof.

Fluids may be injected into the oil reservoir through the wellbore to effect stimulation of the reservoir fluid. For example, such fluid injection is effected during hydraulic fracturing, water flooding, water disposal, gas floods, gas disposal (including carbon dioxide sequestration), steam-assisted gravity drainage ("SAGD") or cyclic steam stimulation ("CSS"). In some embodiments, for example, the same wellbore is utilized for both stimulation and production operations, such as for hydraulically fractured formations or for formations subjected to CSS. In some embodiments, for example, different wellbores are used, such as for formations subjected to SAGD, or formations subjected to waterflooding.

A cased-hole completion involves running wellbore casing down into the wellbore through the production zone. The wellbore casing at least contributes to the stabilization of the oil reservoir after the wellbore has been completed, by at least contributing to the prevention of the collapse of the oil reservoir within which the wellbore is defined.

The annular region between the deployed wellbore casing and the oil reservoir may be filled with cement for effecting zonal isolation (see below). The cement is disposed between the wellbore casing and the oil reservoir for the purpose of effecting isolation, or substantial isolation, of one or more zones of the oil reservoir from fluids disposed in another zone of the oil reservoir. Such fluids include reservoir fluid being produced from another zone of the oil reservoir (in some embodiments, for example, such reservoir fluid being flowed through a production tubing string disposed within and extending through the wellbore casing to the surface), or injected fluids such as water, gas (including carbon dioxide), or stimulations fluids such as fracturing fluid or acid. In this respect, in some embodiments, for example, the cement is provided for effecting sealing, or substantial sealing, of fluid communication between one or more zones of the oil reservoir and one or more others zones of the oil reservoir (for example, such as a zone that is being produced). By effecting the sealing, or substantial sealing, of such fluid communication, isolation, or substantial isolation, of one or more zones of the oil reservoir, from another subterranean zone (such as a producing formation), is achieved. Such isolation or substantial isolation is desirable, for example, for mitigating contamination of a water table within the oil reservoir by the reservoir fluid (e.g. oil, gas, salt water, or combinations thereof) being produced, or the above-described injected fluids.

In some embodiments, for example, the cement is disposed as a sheath within an annular region between the wellbore casing and the oil reservoir. In some embodiments, for example, the cement is bonded to both of the production casing and the oil reservoir.

In some embodiments, for example, the cement also provides one or more of the following functions: (a) strengthens and reinforces the structural integrity of the wellbore, (b) prevents, or substantially prevents, produced reservoir fluid of one zone from being diluted by water from other zones. (c) mitigates corrosion of the wellbore casing, (d) at least contributes to the support of the wellbore casing, and e) allows for segmentation for stimulation and fluid inflow control purposes.

The cement is introduced to an annular region between the wellbore casing and the oil reservoir after the subject wellbore casing has been run into the wellbore. This operation is known as "cementing".

In some embodiments, for example, the wellbore casing includes one or more casing strings, each of which is positioned within the well bore, having one end extending from the well head. In some embodiments, for example, each casing string is defined by jointed segments of pipe. The jointed segments of pipe typically have threaded connections.

Typically, a wellbore contains multiple intervals of concentric casing strings, successively deployed within the previously run casing. With the exception of a liner string, casing strings typically run back up to the surface.

For wells that are used for producing reservoir fluid, few of these actually produce through wellbore casing. This is because producing fluids can corrode steel or form undesirable deposits (for example, scales, asphaltenes or paraffin waxes) and the larger diameter can make flow unstable. In this respect, a production tubing string is usually installed inside the last casing string. The production tubing string is provided to conduct reservoir fluid, received within the wellbore, to the wellhead. In some embodiments, for example. the annular region between the last casing string and the production tubing string may be sealed at the bottom by a packer.

To facilitate fluid communication between the reservoir and the wellbore, the wellbore casing may be perforated, or otherwise include per-existing ports, to provide a fluid passage for enabling flow of reservoir fluid from the reservoir to the wellbore.

In some embodiments, for example, the wellbore casing is set short of total depth. Hanging off from the bottom of the wellbore casing, with a liner hanger or packer, is a liner string. The liner string can be made from the same material as the casing string, but, unlike the casing string, the liner string does not extend back to the wellhead. Cement may be provided within the annular region between the liner string and the oil reservoir for effecting zonal isolation (see below), but is not in all cases. In some embodiments, for example, this liner is perforated to effect fluid communication between the reservoir and the wellbore. In this respect, in some embodiments, for example, the liner string can also be a screen or is slotted. In some embodiments, for example, the production tubing string may be engaged or stung into the liner string, thereby providing a fluid passage for conducting the produced reservoir fluid to the wellhead. In some embodiments, for example, no cemented liner is installed, and this is called an open hole completion or uncemented casing completion.

An open-hole completion is effected by drilling down to the top of the producing formation, and then casing the wellbore. The wellbore is then drilled through the producing formation, and the bottom of the wellbore is left open (i.e. uncased), to effect fluid communication between the reservoir and the wellbore. Open-hole completion techniques include bare foot completions, pre-drilled and pre-slotted liners, and open-hole sand control techniques such as standalone screens, open hole gravel packs and open hole expandable screens. Packers and casing can segment the open hole into separate intervals and ported subs can be used to effect fluid communication between the reservoir and the wellbore.

Referring to FIGS. 1, 3, 8, 10 and 11, the system 10 includes an artificial lift system 12 a wellbore fluid conductor 100. The artificial lift system 12 is provided to contribute to the production of reservoir fluids from the reservoir 22. Suitable exemplary artificial lift systems include a pump, gas-lift systems, and jet lift systems. A pump 12 is described herein, but it is understood that other artificial lift systems could be used The pump 12 is provided to, through mechanical action, energize and effect movement of the reservoir fluid from the reservoir 22, through the wellbore 14, and to the surface 24, and thereby effect production of the reservoir fluid. The wellbore fluid conductor 100 includes a fluid passage 101, and is provided for conducting, through the wellbore 14, fluids being energized and moved by at least the pump 12. It is understood that the reservoir fluid may be energized by other means, including by gas-lift, as will be further discussed below with respect to some embodiments. In this respect, in some implementations using gas-lift to effect production of the reservoir fluid, in addition to the reservoir fluid, the fluid being conducted by through the fluid passage 101 of the wellbore fluid conductor 100, and also being energized and moved by the pump 12, includes gaseous material supplied from the surface and into the wellbore 14, for effecting gas-lift of the reservoir fluid.

The wellbore fluid conductor 100 includes an upstream fluid conductor 102. The upstream fluid 102 conductor receives at least reservoir fluid from the wellbore 14, and conducts the received fluid within the wellbore 14. The upstream fluid conductor 102 is disposed in fluid communication with the pump suction 16 such that at least a fraction of the received fluid being conducted by the upstream fluid conductor 102 is supplied the pump suction. In some embodiments, for example, the wellbore fluid conductor 100 includes wellbore casing 130.

The wellbore fluid conductor 100 also includes a downstream fluid conductor 104, for conducting fluid, that is being discharged by the pump 12 through the pump discharge 18, to the surface, or gaseous material that has been separated by a separator 108 (see below). In some embodiments, for example, the downstream fluid conductor 104 includes a piping or tubing string that extends from the pump discharge 18 to the wellhead 20

The upstream fluid conductor 102 includes a co-operating fluid conductor 106, disposed within the wellbore 14, and a separator 108. The co-operating fluid conductor 106 co-operates with the separator 108 to effect separation of at least a fraction of gaseous material from reservoir fluid being conducted through the upstream fluid conductor 102, prior to its introduction to the pump suction 16, as described below. In some embodiments, for example, the wellbore fluid conductor 100 includes wellbore casing 130, and the wellbore casing 130 includes the co-operating fluid conductor 106.

The co-operating fluid conductor 106 includes an inlet port 110 for receiving reservoir fluids from the reservoir 22, and a downhole wellbore fluid passage 112 for effecting conducting (e.g. flowing) of the received fluid, including reservoir fluid, to the separator 108. In co-operation with the co-operating fluid conductor 106, the separator 108 functions to effect depletion of gaseous material and solids material from the fluid being supplied by the downhole wellbore fluid passage 112, such that a fluid, depleted in gaseous material and solids material, is supplied to the pump suction.

Reservoir fluid may contain gaseous material. As well, in some embodiments, the system 10 may include a gas lift component, in which case suitable infrastructure is provided so as to supply gaseous material for admixing with reservoir fluid received within the wellbore 14 so as to effect a density reduction in the fluid disposed within the wellbore 14 for conduction (such as by flowing) to the pump suction 16 (such density reduction effects a reduction in pressure of the fluid within the wellbore 14, increases drawdown, and thereby facilitates an increased rate of production of reservoir fluid from the reservoir 22).

In either case, it is preferable to at least partially remove gaseous material from the fluid being conducted within the upstream fluid conductor 102, prior to the pump suction 16, in order to mitigate gas interference or gas lock conditions during pump operation. The separator 108, in co-operation with the co-operating fluid conductor 106, is provided to, amongst other things, perform this function.

In those embodiments where gas lift is used to at least contribute to driving the reservoir fluid to the pump suction 16, in some of these embodiments, for example prior to the separating, the density-reduced reservoir fluid is disposed in a multiphase flow regime such that a derivative of the bottomhole pressure with respect to the volumetric flow rate of the gas phase of the density-reduced reservoir fluid (i.e. fluid that has already been mixed with injected gas) is greater than zero (0).

Also in those embodiments where gas lift is used to at least contribute to driving the reservoir fluid to the pump suction 16, in some of these embodiments, for example, prior to the separating, the ratio of the superficial liquid velocity of the liquid phase of the density-reduced reservoir fluid to the superficial gas velocity of the gas phase of the density-reduced reservoir fluid is specified and/or intentionally controlled such that liquid hold-up is minimized by disposing the flow regime within the annular-transition flow regime and/or the mist flow regime. These flow regime patterns are characterized by the presence of a relatively fast moving core of the gaseous phase carrying with it entrained droplets of the liquid phase.

Also in those embodiments where gas lift is used to at least contribute to driving the reservoir fluid to the pump suction 16, in some of these embodiments, for example, the derivative of the bottomhole pressure (for example, measured at the first inlet port 114), with respect to the volumetric flow rate of the gas phase of the density-reduced reservoir fluid, is greater than zero (0). In some embodiments, for example, the derivative of the bottomhole pressure with respect to the volumetric flow of the gaseous material, being supplied to the wellbore and admixed with the received reservoir fluid, is at least 2 kPa per 1000 cubic metres of gaseous material per day, such as, for example, at least 5 kPa per 1000 cubic metres of gaseous material per day, such as, for example, at least 10 kPa per 1000 cubic metres of gaseous material per day, such as, for example, at least 25 kPa per 1000 cubic metres of gaseous material per day, such as, for example, at least 50 kPa per 1000 cubic metres of gaseous material per day. In some of these embodiments, for example, the process is a continuous process that operates continuously for at least 24 hours, such as, for example, at least 48 hours, such as, for example, at least seven (7) days, such as, for example, at least 30 days.

Also in those embodiments where gas lift is used to at least contribute to driving the reservoir fluid to the pump suction 16, in some of these embodiments, for example, the process is operated over an operating time duration of at least 30 days, and over an operative fraction of the operating time duration, the derivative of the bottomhole pressure with respect to the volumetric flow of the gaseous material, being supplied to the wellbore and admixed with the received reservoir fluid, is greater than zero (0), such as, for example, at least 2 kPa per 1000 cubic metres of gaseous material per day, such as, for example, at least 5 kPa per 1000 cubic metres of gaseous material per day, such as, for example, at least 10 kPa per 1000 cubic metres of gaseous material per day, such as, for example, at least 25 kPa per 1000 cubic metres of gaseous material per day, such as, for example, at least 50 kPa per 1000 cubic metres of gaseous material per day. In some embodiment, for example, the operative fraction of the operating time duration is at least 50% of the operating time duration, such as, for example, at least 60% of the operating time duration, such as, for example, at least 70% of the operating time duration, such as, for example, at least 80% of the operating time duration, such as, for example, at least 90% of the operating time duration. It is understood that the process may be operated continuously or intermittently over the cumulative period of time of operation. In this respect, in some embodiments, for example, the operation of process is continuous for the operating time duration. Also, in some embodiments, for example, the operation of the process is intermittent and the operating time duration is defined by an accumulation of time durations during which the process is operating By operating the system such that any one, or any combination of: (i) the density-reduced reservoir fluid is disposed in the annular transition and/or mist flow regimes, and (ii) the derivative of the bottomhole pressure with respect to the volumetric flow rate gas phase of the density-reduced reservoir fluid is greater than zero ("0"), the development of undesirable flow conditions, (such as "bubble flow" or "slug flow") which derogates from efficient lifting of the reservoir fluids, is mitigated By operating the system such that any one, or any combination of: (i) the density-reduced reservoir fluid is disposed in the annular transition and/or mist flow regimes, and (ii) the derivative of the bottomhole pressure with respect to the volumetric flow rate gas phase of the density-reduced reservoir fluid is greater than zero ("0"), the propensity for the development of undesirable inconsistent or unstable fluctuating multiphase flows from the downhole wellbore fluid passage 112 is intentionally reduced or dampened or regulated or smoothened.

The separator 108 includes a first inlet port 114 and at least one first outlet port 606*a* (or 606*b*, 606*c*, or 606*d*, as four are shown). The first inlet port 114 is disposed in fluid communication with the downhole wellbore fluid passage 112 for receiving at least reservoir fluids (see directional arrow 502) from the downhole wellbore fluid passage 112. A reservoir fluid-conducting passage 118 extends between the first inlet port 114 and the first outlet port 606*a*.

Figure 5:
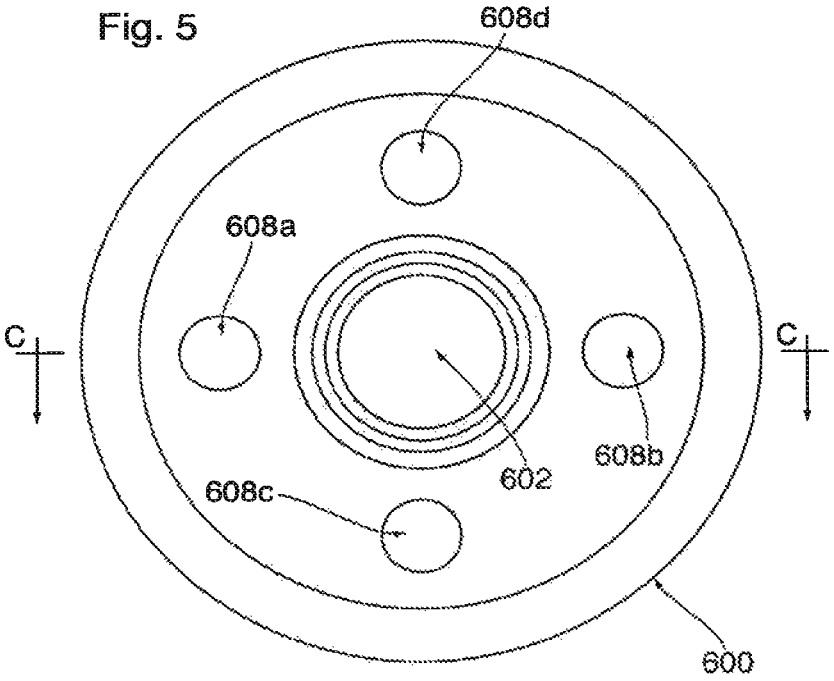
FIG. 5 is a bottom plan view of the flow diverter illustrated in FIG. 4.

Referring to FIG. 5, the separator 108 also includes at least one second inlet port 608*a*, (or 608*b*, 608*c*, 608*d*, as four are shown) and a second outlet port 612. The second inlet port 608*a* is disposed downhole relative to the first outlet port 606*a*. A gas-depleted fluid conducting passage 610*a* extends between the second inlet port 606*a* and the second outlet port 612.

In some embodiments, for example, the first inlet port 114 of the separator 108 is disposed downhole relative to the second outlet port 612 of the separator 108.

The separator 108 further includes a co-operating surface portion 125. The co-operating surface portion 125 co-operates with the co-operating fluid conductor 106 to define an intermediate fluid passage 126 (such as an annular fluid passage) therebetween for effecting fluid communication between the first outlet port 606*a* and the second inlet port 608*a*. While at least reservoir fluid is flowing within the intermediate fluid passage 126 (see directional arrow 504), at least a fraction of gaseous material, within the downwardly flowing fluid within the intermediate fluid passage 126, is separated from the downwardly flowing fluid in response to buoyancy forces, to produce a gaseous material-depleted fluid. The separated gaseous material is conducted uphole (see directional arrow 515) to the wellhead 20 through a conductor 131 that is disposed in fluid communication with the intermediate fluid passage 126, and is discharged above the surface as a gas-rich formation fluid fraction 5102 (see, for example, FIG. 17). In some embodiments, for example, the conductor 131 defines a gas conducting passage 131*a* disposed between the wellbore fluid conductor 100 (such as a wellbore casing) and a pressurized fluid conductor 128 that is extending uphole from a pump discharge 18 (see below). The gaseous material-depleted fluid is conducted (see directional arrow 506) to the pump suction 16 via the gas-depleted fluid conducting passage 124.

The separator 108 is sealingly, or substantially sealingly, disposed relative to the co-operating fluid conductor 106. The sealing, or substantially sealing, disposition is effected downhole relative to the second inlet port 608*a*. The sealing disposition is such that a sealing interface 300 is defined, and such that fluid flow, across the sealed interface 300, is prevented, or substantially prevented. In some embodiments, for example, the sealing, or substantially sealing, disposition of the separator 108 relative to the co-operating fluid conductor 106 is with effect that fluid flow, across the sealed interface 300, in at least a downhole direction, is prevented, or substantially prevented. In some embodiments, for example, the sealing, or substantially sealing, disposition of the separator 108 relative to the co-operating fluid conductor 106 is with effect that fluid, that is being conducted in a downhole direction within the intermediate fluid passage 126, is directed to the second inlet port 608*a*. In this respect, the gaseous material-depleted fluid, produced after the separation of gaseous material within the intermediate fluid passage 126, is directed to the second inlet port 608*a* (see directional arrow 508), and conducted to the pump suction 16 (see directional arrow 506) via the gas-depleted fluid conducting passage 610*a*.

Referring to FIG. 1, in some embodiments, for example, the wellbore fluid conductor 100 may also include a liner 132 that is connected or coupled to (for example, hung from), and sealed, or substantially sealed, relative to, the co-operating fluid conductor 106. The liner 132 includes a liner fluid passage 134, such that the downhole wellbore fluid passage 112 includes the liner fluid passage 132. In some embodiments, for example, the sealed, or substantially sealed, disposition of the liner 132 relative to the co-operating fluid conductor 108 is effected by a packer 136 disposed between the liner 132 and the wellbore casing 130. In some embodiments, for example, the coupling and sealing, or substantially sealing, engagement between the liner 132 and the co-operating fluid conductor, includes coupling and sealing, or substantially sealing, engagement between the liner 132 and the wellbore casing 130. In this respect, in some embodiments, for example, the liner 132 is hung from the wellbore casing 130

In some embodiments, for example, the liner 132 is connected or coupled to (for example, hung from), and is disposed in sealing, or substantially sealing, engagement with the co-operating fluid conductor 106, and the separator 108 is disposed in sealing, or substantially sealing, engagement with the liner 132. In this configuration, the first inlet port 114 is disposed for receiving at least reservoir fluid via the liner fluid passage 134.

In some embodiments, for example, the separator 108 further includes a latch seal assembly 200 releasably coupled to the liner 132, wherein the sealing, or substantially sealing, engagement between the liner 132 and the separator 108 is effected by the latch seal assembly 130. A suitable latch seal assembly 130 is a Weatherford™. Thread-Latch Anchor Seal Assembly™.

In some embodiments, for example, the sealing, or substantially sealing, engagement includes sealing, or substantially sealing, engagement of the liner 132 to a separator sealing surface 156 of the separator 108, and the separator sealing surface 156 includes one or more o-rings or seal-type Chevron rings.

In some embodiments, for example, the sealing, or substantially sealing, engagement includes sealing, or substantially sealing, engagement of the separator 108 to a polished bore receptacle 131 of the liner 132.

In some embodiments, for example, the separator 108 is disposed in an interference fit with the liner 132

In some embodiments, for example, the separator 108 is landed or engaged or "stung" within the liner 132.

In some embodiments, for example, the combination of at least: (a) the sealing, or substantially sealing, engagement of the liner 132 with the wellbore casing 130, and (b) the sealing, or substantially sealing, engagement of the separator 108 with the liner 132, effects the sealing, or substantially sealing, disposition of the separator 108 (and, more specifically, the separator sealing surface 156) relative to the co-operating fluid conductor 106.

In some embodiments, for example, the combination of at least: (i) the sealing, or substantially sealing, engagement between the liner 132 and the co-operating fluid conductor 106, and (ii) the sealing, or substantially sealing, engagement between the separator sealing surface 156 and the liner 132, is such that the separator sealing surface 156 is sealed, or substantially sealed, relative to the co-operating fluid conductor 106 and thereby defines the sealed interface 301, such that fluid flow, across the sealed interface 301, is prevented or substantially prevented.

In some embodiments, for example, the combination of at least: (i) the sealing, or substantially sealing, engagement between the liner 132 and the co-operating fluid conductor 106, and (ii) the sealing, or substantially sealing, engagement between the separator sealing surface 156 and the liner 132, is with effect that fluid flow, across the sealed interface 301, in at least a downhole direction, is prevented or substantially prevented.

In some embodiments, for example, the combination of at least: (i) the sealing, or substantially sealing, engagement between the liner 132 and the co-operating fluid conductor 106, and (ii) the sealing, or substantially sealing, engagement between the separator sealing surface 156 and the liner 132, is with effect that fluid, that is being conducted in a downhole direction within the intermediate fluid passage 126, is directed to the second inlet port 608*a*.

Figure 2:
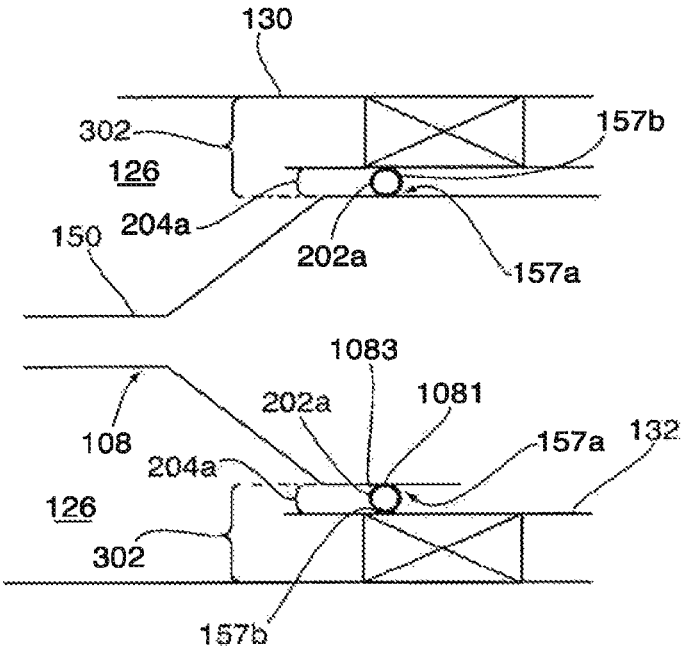
FIG. 2 is an enlarged view of the sealing engagement of the separator to the liner, illustrated in FIG. 1.
Figure 3:
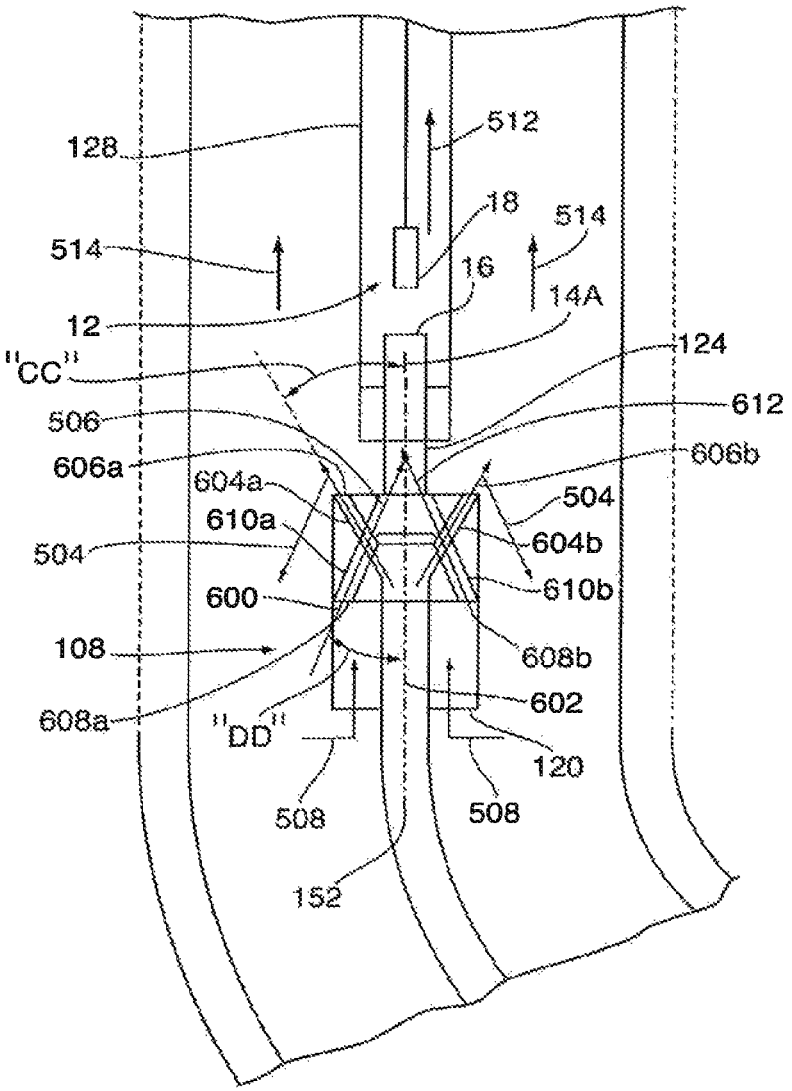
FIG. 3 is an enlarged view of Detail "A" in FIG. 1, illustrating an embodiment of a flow diverter.

Referring to FIG. 2, in some embodiments, for example, the separator 108 includes (or carries) a sealing member 202, and the sealing member 202 is disposed between a sealing member engaging surface portion 157*a* of the separator 108 and the sealing member engaging surface portion 157*b* of the liner 132 for effecting sealing, or substantial sealing, of the sealing member engaging portion 157*a* of the separator 108 relative to the sealing member engaging portion 157*b* of the liner 132. The combination of at least: (i) the sealing, or substantially sealing, engagement between the liner 132 and the wellbore casing 130, and (ii) the sealing, or substantial sealing, of the sealing member-engaging surface portion 157*a* of the separator 108 relative to the sealing member-engaging surface portion 157*b* of the liner 132, effects the sealing, or substantially sealing, disposition of the separator 108 (and, more specifically, the sealing member-engaging surface portion 157*a* of the separator 108) relative to the co-operating fluid conductor 106 and thereby defines a sealed interface 302. The sealing, or substantially sealing, disposition of the separator sealing member engaging surface portion 157*a* of the separator 108 relative to the co-operating fluid conductor 106 is effected downhole relative to the second inlet port 608*a*. Further, this sealing, or substantially sealing, disposition is such that fluid flow, across the sealed interface 302, is prevented or substantially prevented.

In some embodiments, for example, the sealing member 202, having an exposed surface portion 202*a*, that is disposed in fluid communication with the intermediate fluid passage 126, is extending across a gap 204*a*, between the separator 108 and the liner 132, having a minimum distance of less than 2.5 millimitres. In some embodiments, for example, the gap 204*a* has a minimum distance of less than one (1.0) millimetre.

In some embodiments, for example, the inlet port 114 is disposed in fluid communication with the liner fluid passage 134 and in sealing, or substantially sealing, engagement with the liner 132 to prevent, or substantially prevent, the at least reservoir fluid from bypassing the inlet port 114.

Figure 8:
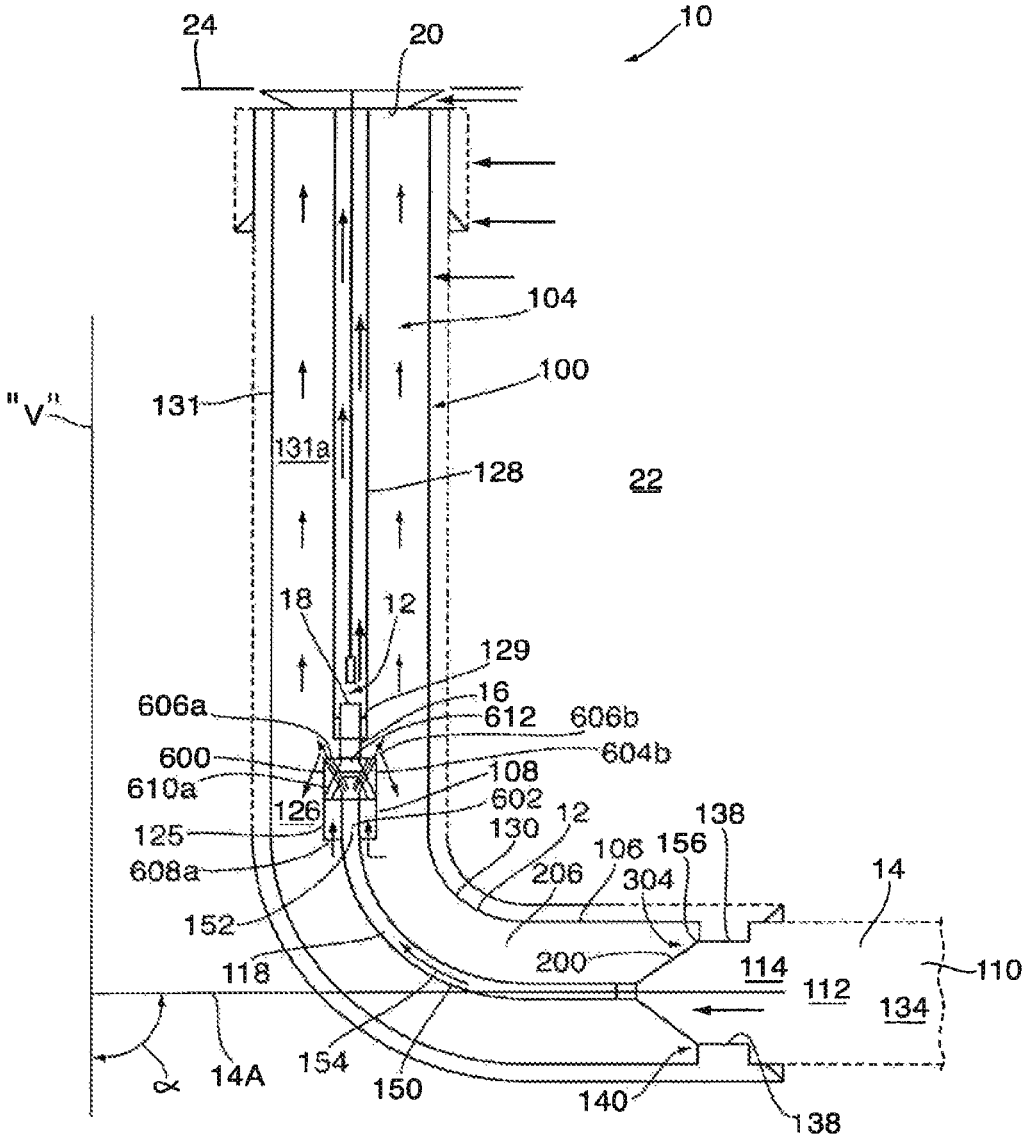
FIG. 8 is a schematic illustration of another embodiment of a system of the present disclosure using a downhole pump.

Referring to FIG. 8, in some embodiments, for example, the co-operating fluid conductor 106 includes a constricted portion 138 of wellbore casing 130. A separator sealing surface 156 is disposed in sealing, or substantially sealing, engagement with a constricted portion 138 of wellbore casing 130, such that the sealing, or substantially sealing, disposition of the separator sealing surface 156 relative to the co-operating fluid conductor 106 is effected by the sealing, or substantially sealing, engagement of the separator sealing surface 156 with the constricted portion 138 and defines a sealed interface 304. The sealing, or substantially sealing, engagement of the separator sealing surface 156 with the constricted portion 138 is effected downhole relative to the second inlet port 608*a* and is with effect that fluid flow, across the sealed interface 304, is prevented, or substantially prevented. In some embodiments, for example, the separator 108 is disposed in an interference fit with the constricted portion 138. In some embodiments, the constricted portion 138 of wellbore casing 130 includes an inwardly extending projection. In some embodiments, for example, the constricted portion 138 of the wellbore casing 130 includes an inwardly extending projection that is installed after the casing has been installed In some embodiments, for example, the sealing, or substantially sealing, engagement between the separator sealing surface 156 and the constricted portion 138 is with effect that fluid flow, across the sealed interface 304, in at least a downhole direction, is prevented, or substantially prevented In some embodiments, for example, the sealing, or substantially sealing, engagement between the separator sealing surface 156 and the constricted portion 138 is with effect that fluid, that is being conducted in a downhole direction within the intermediate fluid passage 126, is directed to the second inlet port 120 (see FIG. 3).

Figure 9:
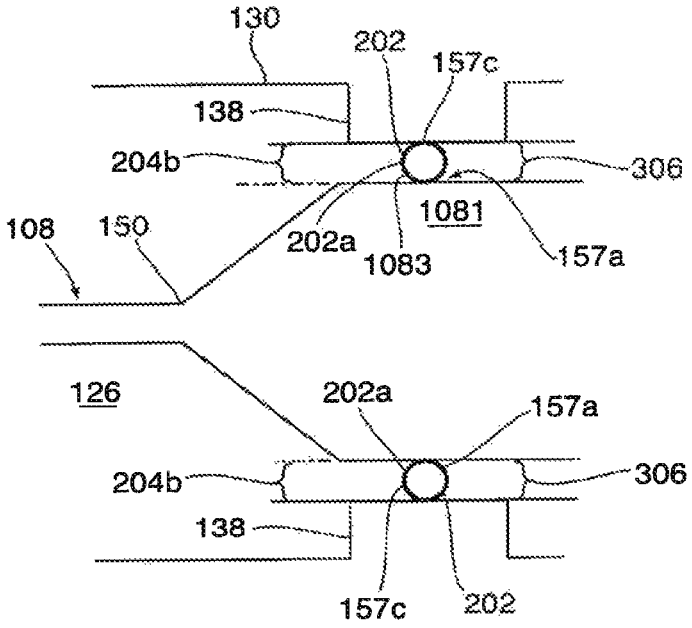
FIG. 9 is an enlarged view of the sealing engagement of the separator to a constricted portion of the wellbore casing, illustrated in FIG. 1.

Referring to FIG. 9, in some embodiments, for example, the separator 108 includes (or carries) a sealing member 202, and the sealing, or substantially sealing, engagement between the separator sealing surface 156 and the constricted portion 138 is effected by the sealing member 202. In this respect, the sealing member 202 is disposed between a sealing member engaging surface portion 157*a* of the separator 108 and a sealing member engaging portion 157*c* of the constricted portion 138 such that a sealed interface 306 is thereby defined, and such that fluid flow, across the sealed interface 306, is prevented, or substantially prevented. The sealing member 202, having an exposed surface portion 202*a*, that is disposed in fluid communication with the intermediate fluid passage 126, is extending across a gap 204*b*, between the separator 208 and the constricted portion 138, having a minimum distance of less than 2.5 millimetres. In some embodiments, for example, the gap 204*b* has a minimum distance of less than one (1) millimetre.

The above-described configurations for sealing, or substantially sealing, disposition of the separator 108 relative to the co-operating fluid conductor 106 provide for conditions which minimize solid debris accumulation in the joint between the separator 108 and the co-operating fluid conductor 106. By providing for conditions which minimize solid debris accumulation within the joint, interference to movement of the separator 108 relative to the co-operating fluid conductor 106, which could be effected by accumulated solid debris, is mitigated.

Referring to FIGS. 1 and 8, In some embodiments, for example, the sealing member 202 is disposed within a section of the wellbore whose axis 14A is disposed at an angle ".alpha." of at least 60 degrees relative to the vertical "V". In some of these embodiments, for example, the sealing member 202 is disposed within a section of the wellbore whose axis 14A is disposed at an angle ".alpha." of at least 85 degrees relative to the vertical "V". In this respect, disposing the sealing member 202 within a wellbore section having such wellbore inclinations minimizes solid debris accumulation on the sealing member 202.

Figure 10:
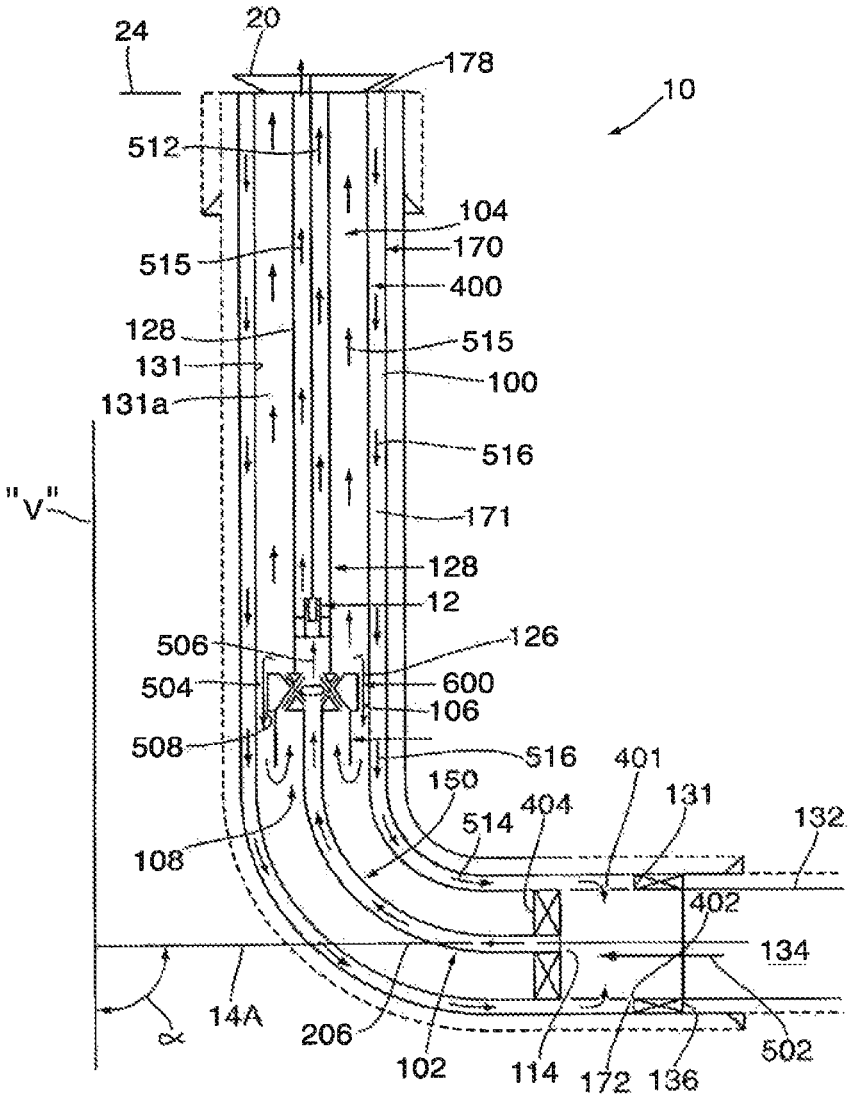
FIG. 10 is a schematic illustration of an embodiment of an artificial lift system of the present disclosure using a downhole pump and gas lift.
Figure 11:
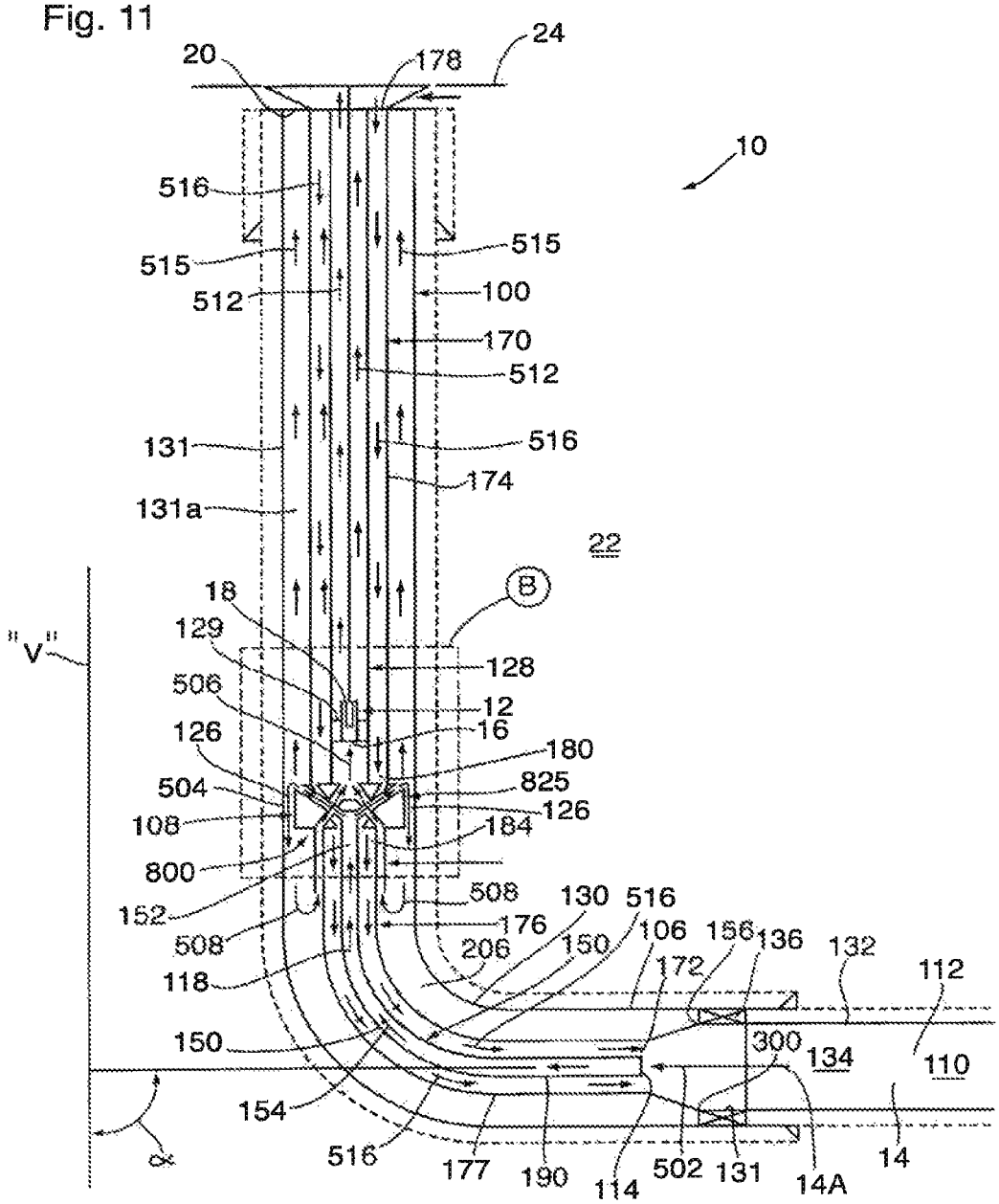
FIG. 11 is a schematic illustration of an embodiment of an artificial lift system of the present disclosure using a downhole pump and gas lift.

Referring to FIGS. 10 and 11, in some embodiments, and as alluded to above, the wellbore fluid conductor 100, for example, is further configured to assist with production of reservoir fluids from the reservoir 22 by providing infrastructure to enable gas lift of the reservoir fluid received within the wellbore 14 from the reservoir. In this respect, in some embodiments, for example, the wellbore fluid conductor 100, includes a gaseous fluid conductor 170 for conducting gaseous material (see directional arrow 516) being supplied as a gaseous material input 5110 (see for example, FIG. 17) from a gaseous material source. The gaseous fluid conductor 170 extends from the surface 124 and into the wellbore 14, and includes a gaseous fluid supply passage 171.

The gaseous fluid conductor 170 includes an inlet port 178 and an outlet port 172. The gaseous fluid conductor 170 is connected to the wellhead 20 and extends from the wellhead 20. The gaseous fluid conductor 170 is disposed in fluid communication with a gaseous material supply source, disposed at the surface 24, via the wellhead 20 and through the inlet port 178, for receiving gaseous material from the gaseous material supply source. The gaseous fluid conductor 170 is configured for conducting the received gaseous material downhole to the outlet port 172. The outlet port 172 is positioned for supplying the conducted gaseous material for admixing with reservoir fluid to produce a density-reduced fluid, upstream of the inlet port 114, such that the density-received fluid is disposed in fluid communication with the inlet port 114 for receiving by the inlet port 114.

In some embodiments, for example, the gaseous fluid conductor 170 includes a piping or tubing string. In some of these embodiments, the piping or tubing string extends from the wellhead 20 and into the wellbore 14.

Referring to FIG. 10, in some embodiments, for example, the gas fluid conductor 170 is defined by the co-operative disposition of a tieback string 400 and the wellbore casing 100. In this respect, the gaseous fluid supply passage 171 is defined as an intermediate passage disposed between the tieback string 400 and the wellbore casing 100. The tieback string 400 extends from the wellhead and into the wellbore, and is disposed in sealing, or substantially sealing, engagement with the liner 132. The tie back string 400 includes one or more openings or apertures 401 which correspondingly define one or more outlet ports 172.

In some embodiments, for example, the tieback string 400 further includes a latch seal assembly 402 releasably coupled to the liner 132, wherein the sealing, or substantially sealing, engagement between the liner 132 and the separator 400 is effected by the latch seal assembly 402. A suitable latch seal assembly 402 is a Weatherford™. Thread-Latch Anchor Seal Assembly.

In some embodiments, for example, the sealing, or substantially sealing, engagement of the tieback string 400 to the liner 132 includes sealing, or substantially sealing, engagement of the tieback string 400 to a polished bore receptacle 131 of the liner 132.

In some embodiments, for example, the tieback string 400 is disposed in an interference fit with the liner 132.

In some embodiments, for example, the tieback string 400 is landed or "stung" within the liner 132

The tieback string 400 defines the co-operating fluid conductor 106, such that the separator 108 is disposed within the tieback string 400. The sealing, or substantially sealing, disposition of the separator 108 relative to the tieback string 400 is effected by at least a packer 404 disposed between the separator 108 and the tieback string 400. In some of these embodiments, for example, the packer 404 is carried by the separator 108. The packer 404 is disposed downhole relative to the second inlet port 608*a*. Referring to FIG. 10, in some embodiments, for example, the packer 404 is disposed within a section of the wellbore whose axis 14A is disposed at an angle ".alpha." of at least 60 degrees relative to the vertical "V". In some of these embodiments, for example, the packer 404 is disposed within a section of the wellbore whose axis 14A is disposed at an angle ".alpha." of at least 85 degrees relative to the vertical "V". In this respect, disposing the packer 404 within a wellbore section having such wellbore inclinations minimizes solid debris accumulation on the packer 404.

The liner 132 is connected or coupled to (such as, for example, by being hung from the wellbore casing 130), and is disposed in sealing, or substantially sealing, engagement with the wellbore casing 130. The liner 132 includes a liner fluid passage 134, such that the downhole wellbore fluid passage 112 includes the liner fluid passage 134, and such that the first inlet port 114 is disposed for receiving at least reservoir fluids via the liner fluid passage 134. In some of these embodiments, for example, the sealing, or substantially sealing, engagement between the liner 132 and the wellbore casing 130 is effected by a packer 136 disposed between the liner 132 and the wellbore casing 130. The packer 136 functions to prevent, or substantially prevent, fluid flow downhole through the intermediate passage disposed between the wellbore casing 130 and the liner 132, and directs the gaseous material, being conducted through the gaseous fluid supply passage 171, to the inlet port 114.

In some embodiments, for example, the separator 108 includes a downhole fluid conductor 150 and a flow diverter 600.

The downhole fluid conductor 150 includes the first inlet port 114, a first intermediate outlet port 152, and a downhole reservoir fluid-conducting passage 154. The downhole reservoir fluid-conducting passage 154 extends between the first inlet port 114 and the intermediate outlet port 152. In some embodiments, for example, the downhole fluid conductor 150 also includes a separator sealing surface 156, such as a separator sealing surface defined by the sealing member 140. In some embodiments, for example, the downhole fluid conductor 150 includes a piping or tubing string. In some embodiments, for example, the downhole fluid conductor 150 includes, or carries, the sealing member 202.

Referring to FIGS. 3 to 7 and 7A to 7G, the flow diverter 600 includes a first diverter inlet port 602, a reservoir fluid passage network 604, a plurality of first diverter outlet ports 606*a*, 606*b*, 606*c*, 606*d*, a plurality of second diverter inlet ports 608*a*, 608*b*, 608*c*, 608*d*, a gas-depleted fluid passage network 610, a second diverter outlet port 612, and a co-operating surface portion 614

The diverter first inlet port 602 is configured for receiving at least reservoir fluids from the downhole wellbore fluid passage.

The reservoir fluid passage network 604 extends between the first diverter inlet port 602 and the first diverter outlet ports 606*a*, 606*b*, 606*c*, 606*d* for effecting fluid coupling of the first diverter inlet port 602 to the first diverter outlet ports 606*a*, 606*b*, 606*c*, 606*d*. The reservoir fluid passage network 604 including a plurality of first fluid passage branches 604*a*, 604*b*, 604*c*, 604*d* (branches 604*c* and 604*d* are not shown), each one of the first fluid passage branches, independently, extending from a respective first diverter outlet port 606*a*, 606*b*, 606*c*, 606*d*. The first diverter inlet port 602 is positioned relative to the first diverter outlet ports 606*a*, 606*b*, 606*c*, 606*d* such that, while the flow diverter 600 is disposed within the wellbore and oriented for receiving at least reservoir fluids via the first diverter inlet port 602, each one of the first diverter outlet ports 606*a*, 606*b*, 606*c*, 606*d*, independently, is disposed uphole relative to the first diverter inlet port 602.

The plurality of second diverter inlet ports 608*a*, 608*b*, 608*c*, 608*d*, are positioned relative to the first diverter outlet ports 606*a*, 606*b*, 606*c*, 606*d* such that, while the flow diverter 600 is disposed within the wellbore and oriented for receiving at least reservoir fluids via the first diverter inlet port 602, each one of the second diverter inlet ports 608*a*, 608*b*, 608*c*, 608*d*, independently, is disposed downhole relative to the first diverter outlet ports 606*a*, 606*b*, 606*c*, 606*d*.

The gas-depleted fluid passage network 610 extends between the second diverter inlet ports 608*a*, 608*b*, 608*c*, 608*d* and the second diverter outlet port 612 for effecting fluid coupling of the second diverter outlet port to the second diverter inlet ports. The gas-depleted fluid passage network 610 includes a plurality of second fluid passage branches 610*a*, 610*b*, 610*c*, 610*d* (branches 610*c* and 610*d* are not shown), each one of the second fluid passage branches, independently, extending from a respective second inlet port 608*a*, 608*b*, 608*c*, 608*d*.

The plurality of second diverter inlet ports 608*a*, 608*b*, 608*c*, 608*d*, are positioned relative to the second diverter outlet port 612 such that, while the flow diverter 600 is disposed within the wellbore and oriented for receiving at least reservoir fluids via the first diverter inlet port 602, each one of the second diverter inlet ports 608*a*, 608*b*, 608*c*, 608*d*, independently, is disposed downhole relative to the second diverter port 612.

The co-operating surface portion 614 is configured for co-operating with the co-operating fluid conductor 108, while the flow diverter 600 is disposed within the wellbore and oriented for receiving at least reservoir fluids via the first diverter inlet port 602, to define the intermediate fluid passage 126 therebetween for effecting fluid communication between the first diverter outlet ports 606*a*, 606*b*, 606*c*, 606*d* and the second diverter inlet ports 608*a*, 608*b*, 608*c*, 608*d*

Referring to FIGS. 4 to 7, in some embodiments, for example, each one of the first fluid passage branches 604*a*, 604*b*, 604*c*, 604*d*, independently, extends from a respective at least one of the first outlet ports and is disposed in fluid communication with the first inlet port 602 such that the plurality of first outlet ports 606*a*, 606*b*, 606*c*, 606*d* is fluidly coupled, by the first fluid passage branches, to the first inlet port.

Figure 6:
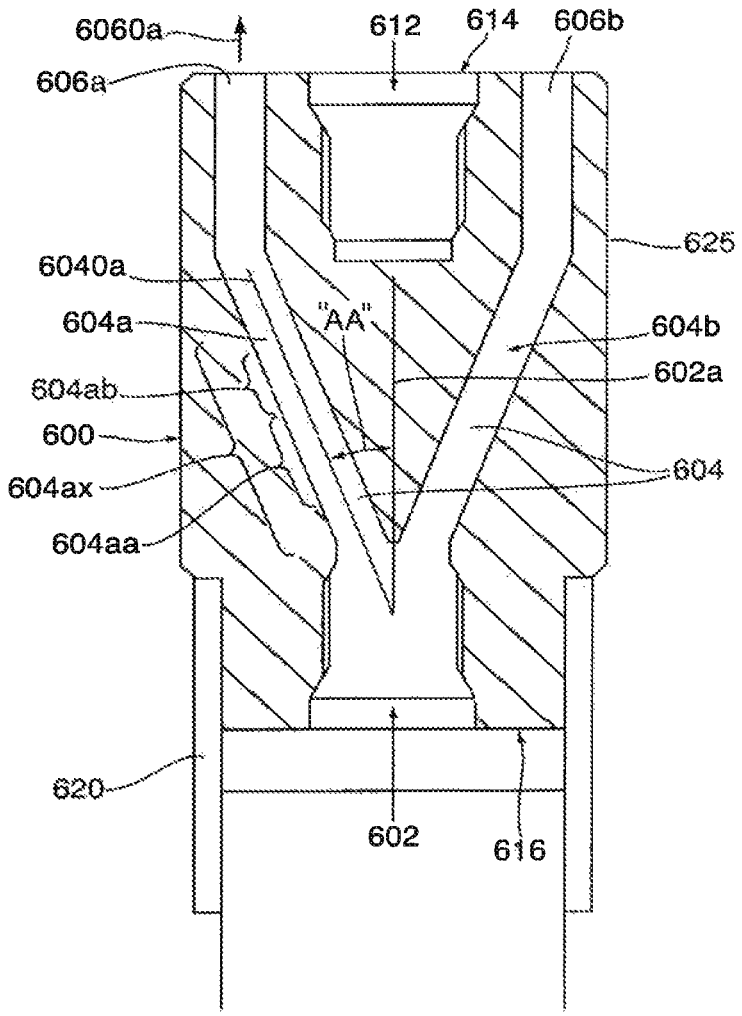
FIG. 6 is a schematic sectional elevation view, taken along lines B-B in FIG. 4, of the flow diverter illustrated in FIG. 4.

Referring to FIG. 6, in some embodiments, for example, for at least one of the first fluid passage branches (in the illustrated embodiment, this is all of the first fluid passage branches 604*a*, 604*b*, 604*c*, 604*d*), the first fluid passage branch (e.g., branch 604*a*) includes one or more first fluid passage branch portions (in the illustrated embodiment, two portions 604*aa*, 604*ab* of branch 604*a* are shown, and these portions 604*aa*, 604*ab* are contiguous), and each one of the one or more first fluid passage branch portions, independently, has an axis 6040*a* that is disposed at an angle "AA" (such as at an angle of less than 30 degrees) relative to the axis 602*a* of the first inlet port 602. In some embodiments, for example, the one or more first fluid passage branch portions define at least a first fluid passage branch fraction 604*ax*, and the axial length of the first fluid passage branch fraction defines at least 25% (such as, for example, at least 50%) of the total axial length of the first fluid passage branch.

In some embodiments, for example, for at least one of the first fluid passage branches (in the illustrated embodiment, this is all of the first fluid passage branches 604*a*, 604*b*, 604*c*, 604*d*), the first fluid passage branch (e.g. branch 604*a*) includes one or more first fluid passage branch portions (e.g., portions 604*aa*, 604*ab*), and with respect to each one of the one or more first fluid passage branch portions (e.g., portions 604*aa*, 604*ab*), independently, the first fluid passage branch portion is oriented such that, while the flow diverter 600 is disposed within a wellbore section and oriented for receiving at least reservoir fluids via the first inlet port 602, the axis 6040*a* of the first fluid passage branch portion is disposed at an angle of less than 30 degrees relative to the axis 14A of the wellbore section within which the diverter 600 is disposed. In some embodiments, for example, the one or more first fluid passage branch portions define at least a first fluid passage branch fraction 604*ax*, and the axial length of the first fluid passage branch fraction defines at least 25% (such as, for example, at least 50%) of the total axial length of the first fluid passage branch In some embodiments, for example, the diverter 600 is configured such that at least one of the first diverter outlet ports 606*a*, 606*b*, 606*c*, 606*d* (such as, for example, each one of the first diverter outlet ports, independently) is radially tangential to the axial plane of the diverter so as to effect a cyclonic flow condition in the reservoir fluid being discharged through one or more of the outlet ports. The disposed radially tangential angle of the at least one outlet ports 606*a*, 606*b*, 606*c*, 606*d* is less than 15 degrees as measured axially along the diverter. In some embodiments, for example, the angle is at least five (5) degrees as measured axially along the diverter.

Figure 4:
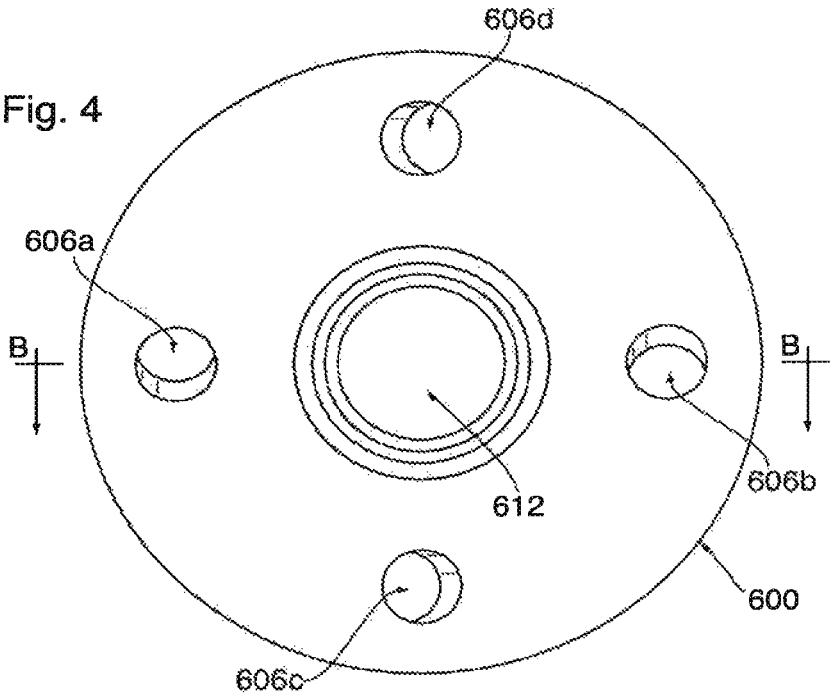
FIG. 4 is a top plan view of an embodiment of a flow diverter.
Figure 4A:
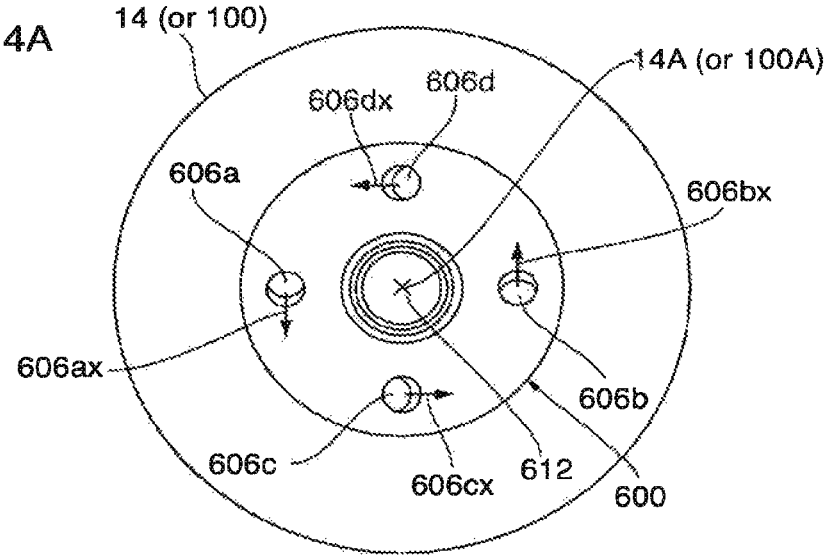
FIG. 4A is a top plan view of an embodiment of a flow diverter disposed within a wellbore fluid conductor, and illustrating a tangential component of fluid that is configured to be discharged from the outlet ports.

Referring to FIG. 4A, in some embodiments, for example, the diverter 600 is configured for disposition within the wellbore 14 such that, while the diverter 600 is disposed within the wellbore (or wellbore fluid conductor) and oriented such that the first diverter inlet 602 is disposed downhole relative to the first diverter outlet ports 606*a*, 606*b*, 606*c*, 606*d*, with respect to at least one of the first diverter outlet ports 606*a*, 606*b*, 606*c*, 606*d* (such as, for example, each one of the first diverter outlet ports), the axis of the first diverter outlet port is: (a) radially offset from the longitudinal axis 14 of the wellbore 14 (or the longitudinal axis 100A of the wellbore fluid conductor 100), and (b) oriented in a direction having a tangential component relative to the longitudinal axis 14A of the wellbore 14 (or the longitudinal axis 100A of the wellbore fluid conductor 100). In some of these embodiments, for example, the diverter 600 is configured for disposition within the wellbore 14 such that, while the diverter 600 is disposed within the wellbore (or wellbore fluid conductor) and oriented such that the first diverter inlet 602 is disposed downhole relative to the first diverter outlet ports 606*a*, 606*b*, 606*c*, 606*d*, with respect to the at least one of the first diverter outlet ports 606*a*, 606*b*, 606*c*, 606*d*, the axis of the at least one first diverter outlet port is disposed at an angle of less than 15 degrees relative to the longitudinal axis 14A of the wellbore (or the longitudinal axis 100A of the wellbore fluid conductor 100). In some embodiments, for example, the angle is greater than five (5) degrees. In some of these embodiments, for example, such orientation of the outlet ports will effect a cyclonic flow condition in the reservoir fluid being discharged through the outlet ports.

Referring to FIG. 4A, in some embodiments, for example, the diverter 600 is configured for disposition within the wellbore 14 such that, while the diverter 600 is disposed within the wellbore (or wellbore fluid conductor) and oriented such that the first diverter inlet 602 is disposed downhole relative to the first diverter outlet ports 606*a*, 606*b*, 606*c*, 606*d*, with respect to at least one of the first diverter outlet ports 606*a*, 606*b*, 606*c*, 606*d* (such as, for example, each one of the first outlet ports, independently), the first diverter outlet port is configured to introduce fluid tangentially (see directional arrows 606*ax*, 606*bx*, 606*cx*, 606*dx*) into the wellbore 14 (or wellbore fluid conductor 100) to induce a moment, on the fluid within the wellbore (or wellbore fluid conductor), about the longitudinal axis 14A of the wellbore 14 (or the longitudinal axis 100A of the wellbore fluid conductor 100). In some of these embodiments, for example, the diverter 600 is further configured for disposition within the wellbore 14 (or wellbore fluid conductor) such that, while the diverter 600 is disposed within the wellbore (or wellbore fluid conductor) and oriented such that the first diverter inlet 602 is disposed downhole relative to the first diverter outlet ports 606*a*, 606*b*, 606*c*, 606*d*, with respect to the at least one of the first diverter outlet ports 606*a*, 606*b*, 606*c*, 606*d*, the axis of the at least one first diverter outlet port is disposed at an angle of less than 15 degrees relative to the longitudinal axis 14A of the wellbore 14 (or the longitudinal axis 100A of the wellbore fluid conductor 100). In some embodiments, for example, the angle is greater than five (5) degrees. In some of these embodiments, for example, such orientation of the outlet ports will effect a cyclonic flow condition in the reservoir fluid being discharged through the outlet ports.

In some embodiments, for example, each one of the second fluid passage branches 610*a*, 610*b*, 610*c*, 610*d*, independently, extends from a respective at least one of the second inlet ports 608*a*, 608*b*, 608*c*, 608*d*, and is disposed in fluid communication with the second outlet port 612 such that the plurality of second inlet ports is fluidly coupled, by the second fluid passage branches, to the second outlet port.

Figure 7:
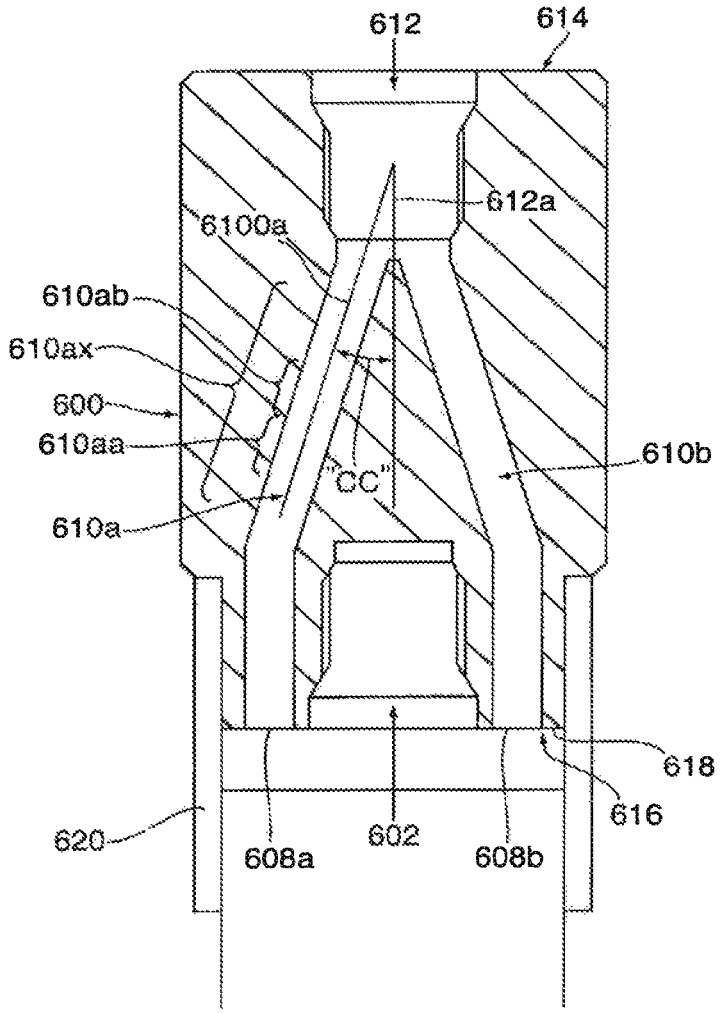
FIG. 7 is a schematic sectional elevation view, taken along lines C-C in FIG. 6, of the flow diverter illustrated in FIG. 4.
Figure 7A:
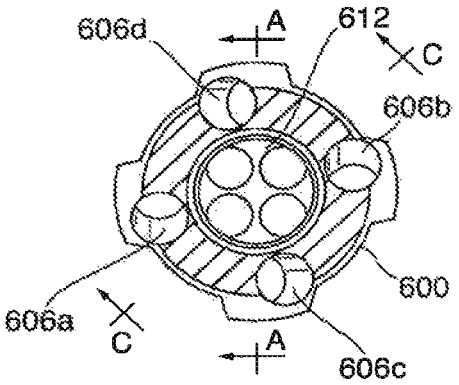
Figure 7B:
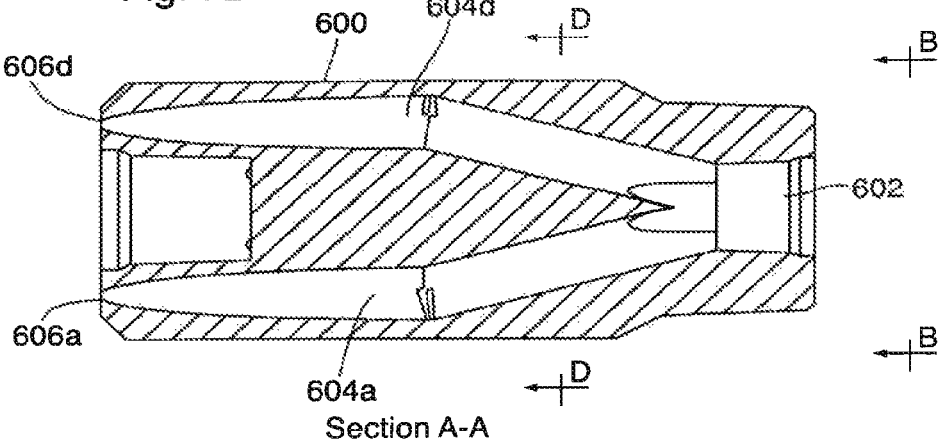
Figure 7C:
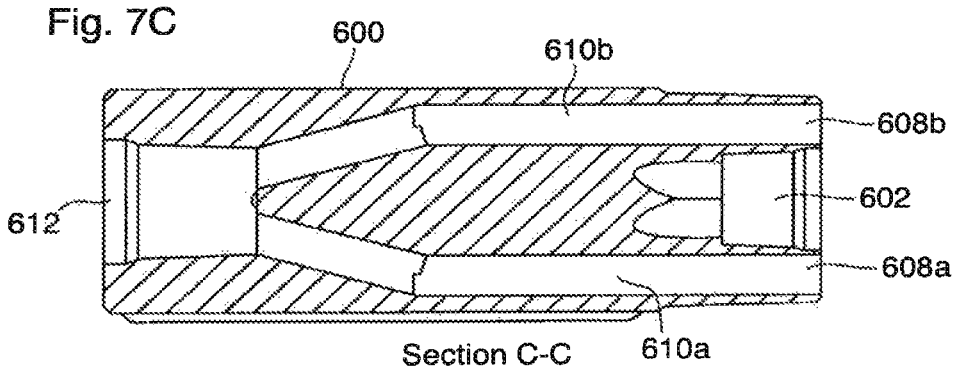
Figure 7D:
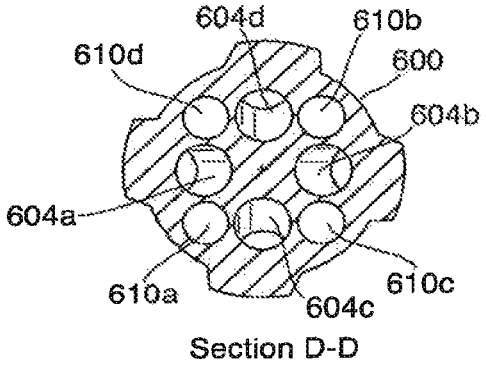
Figure 7E:
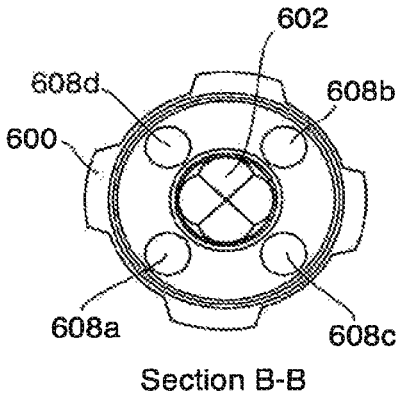
Figure 7F:
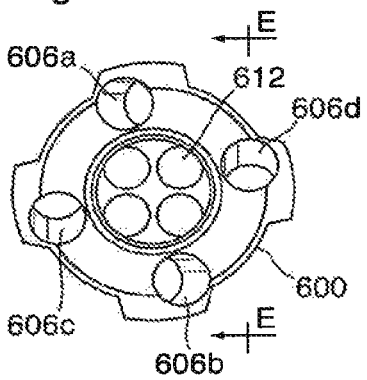
FIG. 7F is a view that is identical to FIG. 7A and provides a frame of reference for FIG. 7G
Figure 7G:
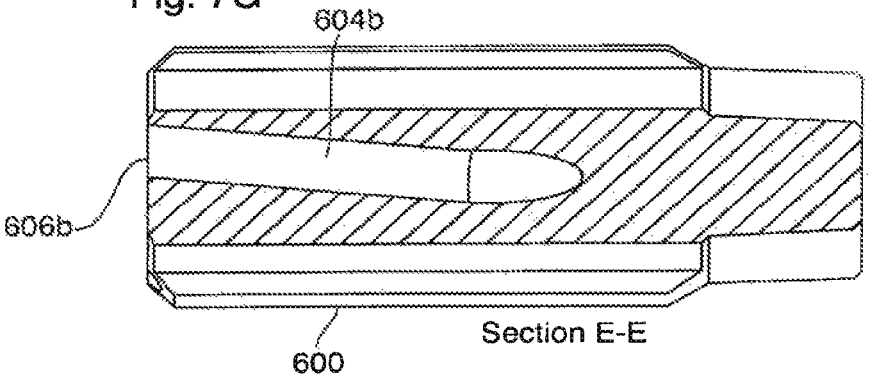
FIG. 7G is a sectional elevation view taken along lines E-E in FIG. 7F.

Referring to FIG. 7, in some embodiments, for example, for at least one of the second fluid passage branches 610*a*, 610*b*, 610*c*, 610*d* (in the illustrated embodiment, this is all of the second fluid passage branches), the second fluid passage branch (e.g. branch 610*a*) includes one or more second fluid passage branch portions (in the illustrated embodiment, two portions 610*aa*, 610*ab* of branch 610*a* are shown, and these portions 610*aa*, 610*ab* are contiguous), and each one of the one or more second fluid passage branch portions, independently, has an axis 6100*a* that is disposed at an angle "CC" (such as, for example, an angle of less than 30 degrees) relative to the axis 612*a* of the second outlet port 612. In some embodiments, for example, the one or more second fluid passage branch portions define at least a second fluid passage branch fraction 610*ax*, and the axial length of the second fluid passage branch fraction defines at least 25% (such as, for example, at least 50%) of the total axial length of the second fluid passage branch.

In some embodiments, for example, for at least one of the second fluid passage branches (in the illustrated embodiment, this is all of the second fluid passage branches) the second fluid passage branch (e.g. branch 610*a*) includes one or more second fluid passage branch portions, and with respect each one of the one or more second fluid passage branch portions (e.g. portions 610*aa*, 610*ab*), independently, the second fluid passage branch portion is oriented such that, while the flow diverter 600 is disposed within a wellbore section and oriented for receiving at least reservoir fluids via the first inlet port 602, the axis 6100*a* of the second fluid passage branch portion is disposed at an angle of less than 30 degrees relative to the axis 14A of the wellbore section within which the diverter is disposed. In some embodiments, for example, the one or more second fluid passage branch portions define at least a second fluid passage branch fraction 606*ax*, and the axial length of the second fluid passage branch fraction defines at least 25% (such as, for example, at least 50%) of the total axial length of the second fluid passage branch.

In some embodiments, for example, by orienting the first and second fluid passage branches in this manner, the flow diverter 600 may be configured with a narrower geometry such that, when disposed within a wellbore, relatively more space (for example, in the form of the intermediate fluid passage 126) is available within the wellbore, between the flow diverter 600 and the casing 130, such that downward velocity of the liquid phase component of the reservoir fluid is correspondingly reduced, thereby effecting an increase in separation efficiency of gaseous material from the reservoir fluid.

In some embodiments, for example, the axis of the first diverter inlet port 602 is disposed in alignment, or substantial alignment, with the axis of the second diverter outlet port 612.

In some embodiments, for example, the flow diverter includes a first side surface 614; and the first diverter outlet ports 606*a*, 606*b*, 606*c*, 606*d* and the second diverter outlet port 612 are disposed in the first side surface 614. Each one of the first diverter outlet ports 606*a*, 606*b*, 606*c*, 606*d* is disposed peripherally from the second diverter outlet port 612.

In some embodiments, for example, the flow diverter 600 includes a second side surface 616, and the second diverter inlet ports 608*a*, 608*b*, 608*c*, 608*d* and the first diverter inlet port 602 are disposed in the second side surface 616. Each one of the second diverter inlet ports is disposed peripherally from the first diverter inlet port 602.

In some embodiments, for example, the first side surface 614 is disposed at an opposite end of the flow diverter 600 relative to the second side surface.

In some embodiments, for example. at least one of the first diverter outlet ports 606*a*, 606*b*, 606*c*, 606*d* (and in the illustrated embodiment, each one of the first diverter outlet ports, independently) is oriented such that, when the flow diverter 600 is disposed within the wellbore 14 and oriented for receiving at least reservoir fluids via the first diverter inlet port 612, a ray (see, for example ray 6060*a*, which corresponds to outlet 606*a*), that is disposed along the axis of the first diverter outlet port, is disposed in an uphole direction at an acute angle of less than 30 degrees relative to the axis of the wellbore portion within which the diverter is disposed. In some implementations, for example, when the flow diverter 600 is disposed within a wellbore section the first outlet port is oriented such that a ray, that is disposed along the axis of the first outlet port, is disposed in an uphole direction at an acute angle of less than 30 degrees relative to the axis of the wellbore section within which the flow diverter is disposed. In some embodiments, for example, the flow diverter 600 is disposed within a vertical, or substantially vertical, section of a wellbore, and the first outlet port is oriented such that a ray, that is disposed along the axis of the first outlet port, is disposed in an uphole direction at an acute angle of less than 30 degrees relative to the vertical (which includes disposition of the ray 6060*a* along a vertical axis). This directs flow from the first diverter outlet port, in an upwardly direction, thereby encouraging gas-liquid separation).

Referring to FIGS. 6 and 7, in some embodiments, for example, the diverter 600 further includes a shroud 620 co-operatively disposed relative to the second inlet ports 608*a*, 608*b*, 608*c*, 608*d* such that, while the flow diverter 600 is disposed within the wellbore 14 and oriented for receiving at least reservoir fluids via the first inlet port 612, the shroud 620 projects below the second inlet ports 608*a*, 608*b*, 608*c*, 608*d*. The co-operating surface 625 includes a surface of the shroud 620. The shroud 620 provides increased residence time for separation of gaseous material within the intermediate fluid passage 126.

In some embodiments, for example. the shroud 620 projects below the second inlet ports 608*a*, 608*b*, 608*c*, 608*d* by a sufficient distance such that the minimum distance, through the intermediate fluid passage 126, from the first outlet port to below the shroud, is at least 1.8 metres.

In some embodiments, for example, the flow diverter 600 includes a body portion 618, the second inlet ports 608*a*, 608*b*, 608*c*, 608*d* being defined within the body portion, and the projecting of the shroud 620 below the second inlet ports 608*a*, 608*b*, 608*c*, 608*d* includes projecting of the shroud below the body portion 618.

In some embodiments, for example, the shroud 620 is co-operatively disposed relative to the second inlet ports 608*a*, 608*b*, 608*c*, 608*d* such that, while the flow diverter 600 is disposed within the wellbore and oriented for receiving at least reservoir fluids via the first inlet port 602, and while fluid is flowing within the intermediate fluid passage 126 in a downhole direction, the flowing fluid is directed below the second inlet ports 608*a*, 608*b*, 608*c*, 608*d*.

In some embodiments, for example, the distance by which the shroud projects below the second inlet ports is selected based on at least: (i) optimization of separation efficiency of gaseous material from reservoir fluid (including density-reduced reservoir fluid), prior to receiving of the reservoir fluid by the second inlet ports, and (ii) optimization of separation efficiency of solid material from reservoir fluid (including density-reduced reservoir fluid), prior to receiving of reservoir fluid by the second inlet ports. In some embodiments, for example, in order to effect the desired separation of solids from the reservoir fluid, so as to mitigate interference of pump operation by solids entrained within reservoir fluid, the upward velocity of the reservoir fluid is less than the solids setting velocity.

The combination of the downhole fluid conductor 150 and the flow diverter 600 is such that the reservoir fluid-conducting passage 118 includes the downhole reservoir fluid-conducting passage 154 and the reservoir fluid passage network 604.

The downhole fluid conductor 150 is connected to the flow diverter 600 such that the intermediate outlet port 152 of the downhole fluid conductor 150 is disposed in fluid communication with the first diverter inlet port 602 of the flow diverter 600, thereby effecting supplying of fluid from the intermediate outlet port 152 to the intermediate inlet port 602. In some embodiments, for example, the downhole reservoir fluid conductor 150 is threadably connected to the flow diverter 600.

In some embodiments, for example, the axis of the second diverter outlet port 612 of the flow diverter 600 is disposed in alignment, or substantial alignment, with the axis of the downhole reservoir fluid-conducting passage 154 of the downhole fluid conductor 150.

The separator 108 is connected to the pump 12 such that the second outlet port 122 is fluidly coupled to the pump suction 16 for supplying gaseous material-depleted fluid to the pump suction 16. In some embodiments, for example, the connection is a threaded connection.

The pump 12 functions to effect transport of at least reservoir fluid from the reservoir 22 to the surface 24. In some embodiments, for example, the pump 12 is a sucker rod pump. Other suitable pumps include screw pumps, electrical submersible pumps, and jet pumps.

The pressurized fluid conductor 128 is connected to the pump discharge 18 such that an inlet port 129 of the pressurized fluid conductor 128 is fluidly coupled to the pump discharge 18 for receiving pressurized gaseous material-depleted fluid being discharged by the pump 12. The pressurized fluid conductor 128 extends to the surface 24 via the wellhead 20, to thereby effect transport of the gaseous material-depleted fluid to the surface 24 (see directional arrow 512) such that it is discharged above the surface as a liquid-rich formation fluid fraction 5104 (see, for example, FIG. 17). The pressurized fluid conductor 128 is hung from the wellhead.

In some embodiments, for example, the pressurized fluid conductor 128 and pump 12 can be disconnected and retrieved independently of the flow diverter 600. The retrieved pressurized fluid conductor 128 and the pump 12 can be then reconnected to the flow diverter 600.

The reservoir fluid produced through the pressurized fluid conductor 128 may be discharged through the wellhead 20 to a collection facility, such as a storage tank within a battery.

Figure 12:
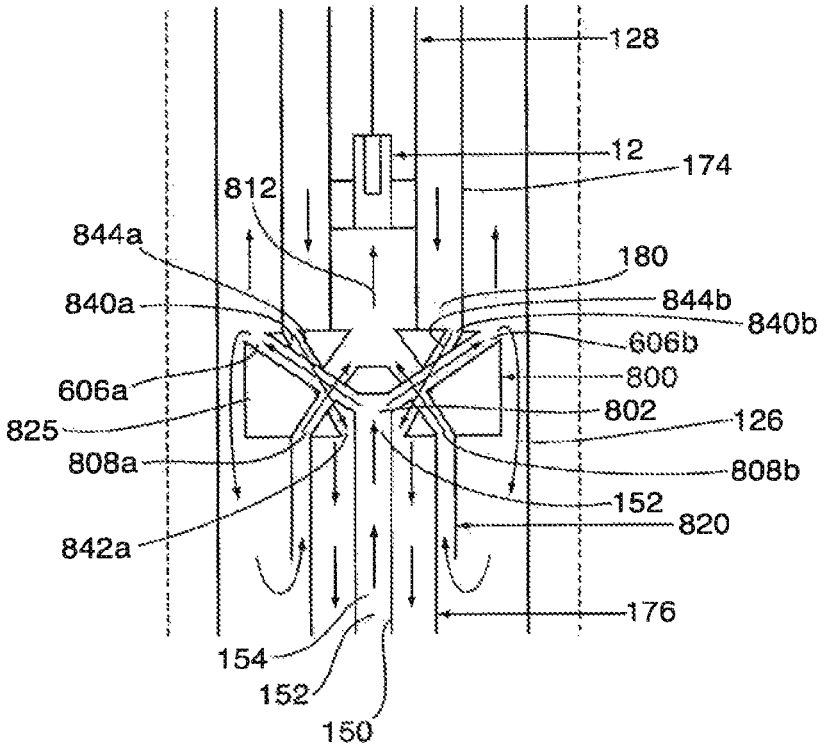
FIG. 12 is an enlarged view of Detail "B" in FIG. 10, illustrating the flow diverter.

Referring to FIG. 11, in some embodiments, for example, in order to enable gas lift of the reservoir fluid received within the wellbore 14 from the reservoir, the wellbore fluid conductor 100 may be configured to supply gaseous material without relying on a tieback string to, in part, define the gaseous fluid conductor. In some of these embodiments, for example, the separator 108 may include a flow diverter 800 (see FIGS. 12, 13, and 14), with the flow diverter configured for directing flow of supplied gaseous material upstream of the inlet port 114 for admixing with reservoir fluid within the wellbore to produce a density-reduced fluid, while also directing flow of the density-reduced fluid for facilitating separation of gaseous and liquid materials from the density reduced fluid to produce a liquid-rich fluid (at least a fraction of gaseous and solid materials having been separated from the density-reduced fluid), and conducting the liquid-rich fluid to a pump, or another mechanical-based lift apparatus. Relative to the diverter 600, the diverter 800 additionally facilitates conducting of gaseous material downhole so as to enable gas-lift.

In such case, the gaseous fluid conductor 170 may be provided including an uphole gaseous fluid conductor 174, including an uphole gas conducting passage 175, and a downhole gaseous fluid conductor 176 including the downhole gas-conducting passage 177.

The uphole gaseous fluid conductor 174 extends between the surface 24 and the flow diverter 800. In this respect, in some embodiments, for example, the uphole gaseous fluid conductor 174 is connected to the wellhead 20 and extends from the wellhead 20, and is disposed in fluid communication with a gaseous material supply source, disposed at the surface 24, via the wellhead 20 and through an inlet port 178 of the uphole gaseous fluid conductor 174, for receiving gaseous material from the gaseous material supply source and conducting the received gaseous material to the flow diverter 800.

The downhole gaseous fluid conductor 176 fluidly communicates with the uphole gaseous fluid conductor 174 via the flow diverter 800. The downhole gaseous fluid conductor 176 extends downhole from the flow diverter 800 to a position whereby the outlet port 172 of the downhole gaseous fluid conductor 176 is disposed for supplying the conducted gaseous material for admixing with reservoir fluid to produce a density-reduced fluid, upstream of the inlet port 114 of the downhole reservoir fluid conductor 150, such that the density-received fluid is disposed in fluid communication with the inlet port 114 of the downhole fluid conductor 150 for receiving by the inlet port 114 of the downhole fluid conductor 150.

Figure 13:
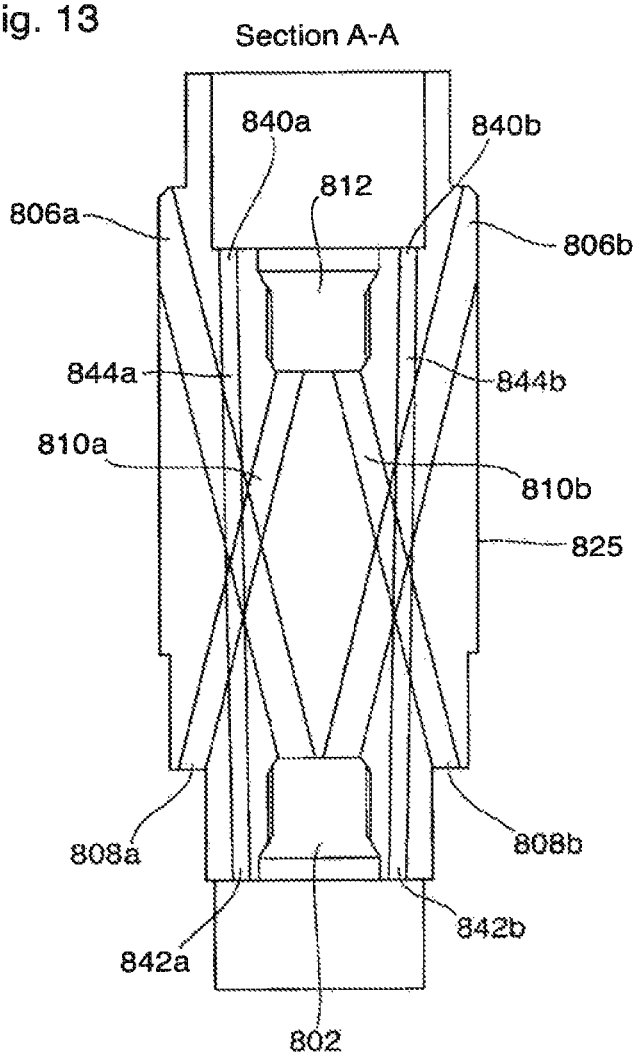
FIG. 13 is a schematic illustration of a flow diverter of the embodiment illustrated in FIG. 10.
Figure 14:
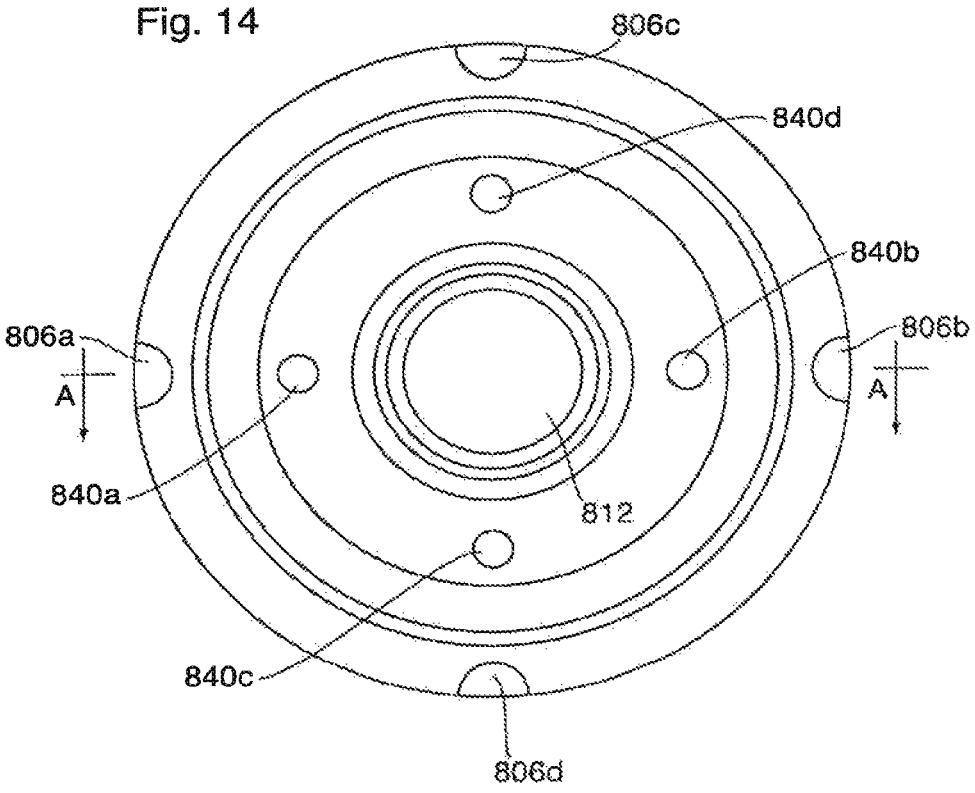
FIG. 14 is a top plan view of the flow diverter illustrated in FIG. 12.
Figure 15:
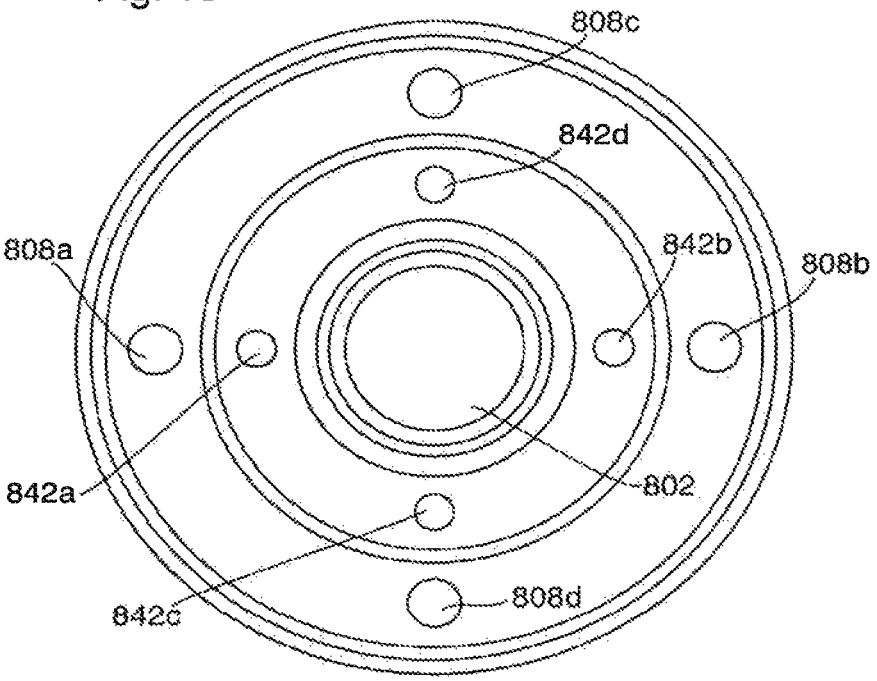
FIG. 15 is a bottom plan view of the flow diverter illustrated in FIG. 12.

Referring to FIGS. 13 to 15, the flow diverter 800 includes a plurality of gas inlet ports 840*a*, 840*b*, 840*c*, 840*d*, a plurality of gas outlet port 842*a*, 842*b*, 842*c*, 842*d*, and a plurality of diverter gas-conducting passages 844*a*, 844*b*, 844*c*, 844*d*. Each one of the gas inlet ports 840*a*, 840*b*, 840*c*, 840*d* is fluidly coupled to a respective one of the gas outlet ports 842*a*, 842*b*, 842*c*, 842*d* by a respective one of the diverter gas-conducting passages 844*a*, 844*b*, 844*c*, 844*d*.

In this respect, the uphole gaseous fluid conductor 174 is connected to the flow diverter 800 such that an outlet port 180 of the uphole gaseous fluid conductor 174 is fluidly coupled to the gas inlet ports 840*a*, 840*b*, 840*c*, 840*d* for supplying the conducted gaseous material to the gas inlet ports 840*a*, 840*b*, 840*c*, 840*d* of the flow diverter 800. Also in this respect, the downhole gaseous fluid conductor 176 is connected to the flow diverter 800 such that fluid communication between the gas outlet ports 842*a*, 842*b*, 842*c*, 842*d* of the flow diverter 800 and an inlet port 184 of the downhole gaseous fluid conductor 176 is effected. In effect, the flow diverter 800 effects fluid coupling between the uphole and downhole gaseous fluid conductors 174,176.

In receiving the density-reduced reservoir fluid, the flow diverter 800 also includes a first diverter inlet port 802, a reservoir fluid passage network 804, a plurality of first diverter outlet ports 806*a*, 806*b*, 806*c*, 806*d*, a plurality of second diverter inlet ports 808*a*, 808*b*, 808*c*, 808*d*, a gas-depleted fluid passage network 810, a second diverter outlet port 812, and a co-operating surface portion 814.

The diverter first inlet port 802 is configured for receiving at least reservoir fluids from the downhole wellbore fluid passage.

The reservoir fluid passage network 804 extends between the first diverter inlet port 802 and the first diverter outlet ports 806*a*, 806*b*, 806*c*, 806*d* for effecting fluid coupling of the first diverter inlet port 802 to the first diverter outlet ports 806*a*, 806*b*, 806*c*, 806*d*. The reservoir fluid passage network 804 including a plurality of first fluid passage branches 804*a*, 804*b*, 804*c*, 804*d*, each one of the first fluid passage branches, independently, extending from a respective first diverter outlet port 806*a*, 806*b*, 806*c*, 806*d*. The first diverter inlet port 802 is positioned relative to the first diverter outlet ports 806*a*, 806*b*, 806*c*, 806*d* such that, while the flow diverter 800 is disposed within the wellbore and oriented for receiving at least reservoir fluids via the first diverter inlet port 802, each one of the first diverter outlet ports 806*a*,

806*b*, 806*c*, 806*d*, independently, is disposed uphole relative to the first diverter inlet port 802.

The plurality of second diverter inlet ports 808*a*, 808*b*, 808*c*, 808*d*, are positioned relative to the first diverter outlet ports 806*a*, 806*b*, 806*c*, 806*d* such that, while the flow diverter 800 is disposed within the wellbore and oriented for receiving at least reservoir fluids via the first diverter inlet port 802, each one of the second diverter inlet ports 808*a*, 808*b*, 808*c*, 808*d*, independently, is disposed downhole relative to the first diverter outlet ports 806*a*, 806*b*, 806*c*, 806*d*

The gas-depleted fluid passage network 810 extends between the second diverter inlet ports 808*a*, 808*b*, 808*c*, 808*d* and the second diverter outlet port 812 for effecting fluid coupling of the second diverter outlet port to the second diverter inlet ports. The gas-depleted fluid passage network 810 includes a plurality of second fluid passage branches 810*a*, 810*b*, 810*c*, 810*d*, each one of the second fluid passage branches, independently, extending from a respective second inlet port 808*a*, 808*b*, 808*c*, 808*d*.

The plurality of second diverter inlet ports 808*a*, 808*b*, 808*c*, 808*d*, are positioned relative to the second diverter outlet port 812 such that, while the flow diverter 800 is disposed within the wellbore and oriented for receiving at least reservoir fluids via the first diverter inlet port 802, each one of the second diverter inlet ports 808*a*, 808*b*, 808*c*, 808*d*, independently, is disposed downhole relative to the second diverter port 812.

The co-operating surface portion 825 is configured for co-operating with the co-operating fluid conductor 108, while the flow diverter 800 is disposed within the wellbore and oriented for receiving at least reservoir fluids via the first diverter inlet port 802, to define the intermediate fluid passage 126 therebetween for effecting fluid communication between the first diverter outlet ports 806*a*, 806*b*, 806*c*, 806*d* and the second diverter inlet ports 808*a*, 808*b*, 808*c*, 808*d*.

Referring to FIGS. 12 to 15 in some embodiments, for example, each one of the first fluid passage branches 804*a*, 804*b*, 804*c*, 804*d*, independently, extends from a respective at least one of the first outlet ports and is disposed in fluid communication with the first inlet port such that the plurality of first outlet ports is fluidly coupled, by the first fluid passage branches, to the first inlet port.

In some embodiments, for example, for at least one of the first fluid passage branches (in the illustrated embodiment, this is all of the first fluid passage branches 804*a*, 804*b*, 804*c*, 804*d*), the first fluid passage branch includes one or more first fluid passage branch portions, and each one of the one or more first fluid passage branch portions, independently, has an axis that is disposed at an angle of less than 30 degrees relative to the axis of the first inlet port. In some embodiments, for example, the one or more first fluid passage branch portions define at least a first fluid passage branch fraction, and the axial length of the first fluid passage branch fraction defines at least 25% (such as, for example, at least 50%) of the total axial length of the first fluid passage branch.

In some embodiments, for example, for at least one of the first fluid passage branches (in the illustrated embodiment, this is all of the first fluid passage branches 804*a*, 804*b*, 804*c*, 804*d*), the first fluid passage branch includes one or more first fluid passage branch portions, and with respect to each one of the one or more first fluid passage branch portions, independently, the first fluid passage branch portion is oriented such that, while the flow diverter is disposed within a wellbore section and oriented for receiving at least reservoir fluids via the first inlet port, the first fluid passage branch portion is disposed at an angle of less than 30 degrees relative to the axis of the wellbore section within which the diverter is disposed. In some embodiments, for example, the one or more first fluid passage branch portions define at least a first fluid passage branch fraction, and the axial length of the first fluid passage branch fraction defines at least 25% (such as, for example, at least 50%) of the total axial length of the first fluid passage branch.

In some embodiments, for example, like the diverter 600, the diverter 800 is configured so as to effect a cyclonic flow condition in the reservoir fluid being discharged through one or more of the outlets.

In this respect, in some embodiments, for example, the diverter 800 is configured such that at least one of the first diverter outlet ports 806*a*, 806*b*, 806*c*, 806*d* (such as, for example, each one of the first diverter outlet ports, independently) is radially tangential to the axial plane so as to effect a cyclonic flow condition in the reservoir fluid being discharged through one or more of the outlet ports. The disposed radially tangential angle of the at least one outlet ports 806*a*, 806*b*, 806*c*, 806*d* is less than 15 degrees as measured axially along the diverter. In some embodiments, for example, the angle is greater than five (5) degrees.

In some embodiments, for example, the diverter 800 is configured for disposition within the wellbore 14 (or wellbore fluid conductor) such that, while the diverter 800 is disposed within the wellbore (or wellbore fluid conductor) and oriented such that the first diverter inlet 802 is disposed downhole relative to the first diverter outlet ports 806*a*, 806*b*, 806*c*, 806*d*, with respect to at least one of the first diverter outlet ports 806*a*, 806*b*, 806*c*, 806*d* (such as, for example, each one of the first diverter outlet ports), the axis of the first diverter outlet port is: (a) radially offset from the longitudinal axis of the wellbore (or wellbore fluid conductor), and (b) oriented in a direction having a tangential component relative to the longitudinal axis of the wellbore (or wellbore fluid conductor). In some of these embodiments, for example, the diverter 800 is configured for disposition within the wellbore 14 (or wellbore fluid conductor) such that, while the diverter 800 is disposed within the wellbore (or wellbore fluid conductor) and oriented such that the first diverter inlet 802 is disposed downhole relative to the first diverter outlet ports 806*a*, 806*b*, 806*c*, 806*d*, with respect to the at least one of the first diverter outlet ports 806*a*, 806*b*, 806*c*, 806*d*, the axis of the at least one first diverter outlet port is disposed at an angle of less than 15 degrees relative to the longitudinal axis of the wellbore (or wellbore fluid conductor). In some embodiments, for example, the angle is greater than five (5) degrees. In some of these embodiments, for example, such orientation of the outlet ports will effect a cyclonic flow condition in the reservoir fluid being discharged through the outlet ports In some embodiments, for example, the diverter 800 is configured for disposition within the wellbore 14 (or wellbore fluid conductor) such that, while the diverter 800 is disposed within the wellbore (or wellbore fluid conductor) and oriented such that the first diverter inlet 802 is disposed downhole relative to the first diverter outlet ports 806*a*, 806*b*, 806*c*, 806*d*, with respect to at least one of the first diverter outlet ports 806*a*, 806*b*, 806*c*, 806*d* (such as, for example, each one of the first outlet ports, independently), the first diverter outlet port is configured to introduce fluid tangentially into the wellbore (or wellbore fluid conductor) to induce a moment, on the fluid within the wellbore (or wellbore fluid conductor), about the longitudinal axis of the wellbore (or wellbore fluid conductor). In some of these embodiments, for example, the diverter 800 is further configured for disposition within the wellbore 14 (or wellbore fluid conductor) such that, while the diverter 800 is disposed within the wellbore (or wellbore fluid conductor) and oriented such that the first diverter inlet 802 is disposed downhole relative to the first diverter outlet ports 806*a*, 806*b*, 806*c*, 806*d*, with respect to the at least one of the first diverter outlet ports 806*a*, 806*b*, 806*c*, 806*d*, the axis of the at least one first diverter outlet port is disposed at an angle of less than 15 degrees relative to the longitudinal axis of the wellbore (or wellbore fluid conductor). In some embodiments, for example, the angle is greater than five (5) degrees. In some of these embodiments, for example, such orientation of the outlet ports will effect a cyclonic flow condition in the reservoir fluid being discharged through the outlet ports.

In some embodiments, for example, each one of the second fluid passage branches 810*a*, 810*b*, 810*c*, 810*d*, independently, extends from a respective at least one of the second inlet ports and is disposed in fluid communication with the second outlet port such that the plurality of second inlet ports is fluidly coupled, by the second fluid passage branches, to the second outlet port.

In some embodiments, for example, for at least one of the second fluid passage branches (in the illustrated embodiments, this is all of the second fluid passage branches 810*a*, 810*b*, 810*c*, 810*d*), the second fluid passage branch (e.g. branch 810*a*) includes one or more second fluid passage branch portions (in the illustrated embodiment, two portions 810*aa*, 810*ab*, of branch 810*a* are shown, and these portions 810*aa*, 810*ab* are contiguous), and each one of the one or more second fluid passage branch portions, independently, has an axis that is disposed at an angle of less than 30 degrees relative to the axis of the second outlet port. In some embodiments, for example, the one or more second fluid passage branch portions define at least a second fluid passage branch fraction, and the axial length of the second fluid passage branch fraction defines at least 255 (such as, for example at least 50%) of the total axial length of the second fluid passage branch.

In some embodiments, for example, for at least one of the second fluid passage branches (in the illustrated embodiment, this is all of the second fluid passage branches 810*a* 810*b*, 810*c*, 810*d*), the second fluid passage branch (e.g. 810*a*) includes one or more second fluid passage branch portions (e.g. portions 810*aa*, 810*ab*), and with respect each one of the one or more second fluid passage branch portions, independently, the second fluid passage branch portion is oriented such that, while the flow diverter is disposed within a wellbore section and oriented for receiving at least reservoir fluids via the first inlet port, the second fluid passage branch portion is disposed at an angle of less than 30 degrees relative to the axis of the wellbore section within which the diverter is disposed. In some embodiments, for example, the one or more second fluid passage branch portions define at least a second fluid passage branch fraction, and the axial length of the second fluid passage branch fraction defines at least 25% (such as, for example, at least 50%) of the total axial length of the second fluid passage branch.

In some embodiments, for example, by orienting the first and second fluid passage branches in this manner, the flow diverter 800 may be configured with a narrower geometry such that, when disposed within a wellbore, relatively more space (for example, in the form of the intermediate fluid passage 126) is available within the wellbore, between the flow diverter 800 and the casing 130, such that downward velocity of the liquid phase component of the reservoir fluid is correspondingly reduced, thereby effecting an increase in separation efficiency of gaseous material from the reservoir fluid.

In some embodiments, for example, the axis of the first diverter inlet port 802 is disposed in alignment, or substantial alignment, with the axis of the second diverter outlet port 812.

In some embodiments, for example, the flow diverter includes a first side surface 814; and the first diverter outlet ports 806*a*, 806*b*, 806*c*, 806*d* and the second diverter outlet port 812 are disposed in the first side surface 814. Each one of the first diverter outlet ports 806*a*, 806*b*, 806*c*, 806*d* is disposed peripherally from the second diverter outlet port 812.

In some embodiments, for example, the flow diverter 800 includes a second side surface 816, and the second diverter inlet ports 808*a*, 808*b*, 808*c*, 808*d* and the first diverter inlet port 802 are disposed in the second side surface 816. Each one of the second diverter inlet ports is disposed peripherally from the first diverter inlet port 802.

In some embodiments, for example, the first side surface 814 is disposed at an opposite end of the flow diverter 800 relative to the second side surface.

In some embodiments, for example. at least one of the first diverter outlet ports 806*a*, 806*b*, 806*c*, 806*d* (and in the illustrated embodiment, each one of the first diverter outlet ports, independently) is oriented such that, when the flow diverter 800 is disposed within a section of the wellbore 14 and oriented for receiving at least reservoir fluids via the first diverter inlet port 812, a ray (see, for example ray 8060*a*, which corresponds to outlet 806*a*), that is disposed along the axis of the first diverter outlet port, is disposed in an uphole direction at an acute angle of less than 30 degrees relative to the axis of the wellbore section within which the flow diverter 800 is disposed. In some implementations, for example, when the diverter 800 is disposed within a section of the wellbore, the first outlet port is oriented such that a ray, that is disposed along the axis of the first outlet port, is disposed in an uphole direction at an acute angle of less than 30 degrees relative to the axis of the wellbore section within which the flow diverter 800 is disposed. In some embodiments, for example, the flow diverter 600 is disposed within a vertical, or substantially vertical, section of a wellbore, and the first outlet port is oriented such that a ray, that is disposed along the axis of the first outlet port, is disposed in an uphole direction at an acute angle of less than 30 degrees relative to the vertical (which includes disposition of the ray 6060*a* along a vertical axis). This directs flow from the first diverter outlet port, in an upwardly direction, thereby encouraging gas-liquid separation).

Referring to FIG. 13, in some embodiments, for example, the diverter 800 further includes a shroud 820 co-operatively disposed relative to the second inlet ports 808*a*, 808*b*, 808*c*, 808*d* such that, while the flow diverter 800 is disposed within the wellbore 14 and oriented for receiving at least reservoir fluids via the first inlet port 812, the shroud 820 projects below the second inlet ports 808*a*, 808*b*, 808*c*, 808*d*. The co-operating surface 825 includes a surface of the shroud 820. The shroud 820 provides increased residence time for separation of gaseous material within the intermediate fluid passage 126.

In some embodiments, for example. the shroud 820 projects below the second inlet ports 808*a*, 808*b*, 808*c*, 808*d* by a sufficient distance such that the minimum distance, through the intermediate fluid passage 126, from the first outlet port to below the shroud, is at least 1.8 metres.

In some embodiments, for example, the flow diverter 800 includes a body portion 818, the second inlet ports 808*a*, 808*b*, 808*c*, 808*d* being defined within the body portion, and the projecting of the shroud 820 below the second inlet ports 808*a*, 808*b*, 808*c*, 808*d* includes projecting of the shroud below the body portion 818

In some embodiments, for example, the shroud 820 is co-operatively disposed relative to the second inlet ports 808*a*, 808*b*, 808*c*, 808*d* such that, while the flow diverter 800 is disposed within the wellbore and oriented for receiving at least reservoir fluids via the first inlet port 802, and while fluid is flowing within the intermediate fluid passage 126 in a downhole direction, the flowing fluid is directed below the second inlet ports 808*a*, 808*b*, 808*c*, 808*d*.

As with the diverter 600, in some embodiments, for example, the distance by which the shroud 820 of the flow diverter 800 projects below the second inlet ports is selected based on at least: (i) optimization of separation efficiency of gaseous material from reservoir fluid (including density-reduced reservoir fluid), prior to receiving of the reservoir fluid for density-reduced reservoir fluid) by the second inlet ports, and (ii) optimization of separation efficiency of solid material from reservoir fluid (including density-reduced reservoir fluid), prior to receiving of the reservoir fluid by the second inlet ports. In some embodiments, for example, in order to effect the desired separation of solids from the reservoir fluid, so as to mitigate interference of pump operation by solids entrained within reservoir fluid, the upward velocity of the reservoir fluid is less than the solids setting velocity.

In some embodiments, for example, after having been discharged above the surface, the liquid-rich formation fluid fraction 5104 and the gas-rich formation fluid fraction 5102 may be re-combined, such that a produced formation fluid, including the liquid-rich formation fluid fraction 5104 and the gas-rich formation fluid fraction 5102, is produced. The produced formation fluid may then be further processed.

Figure 17:
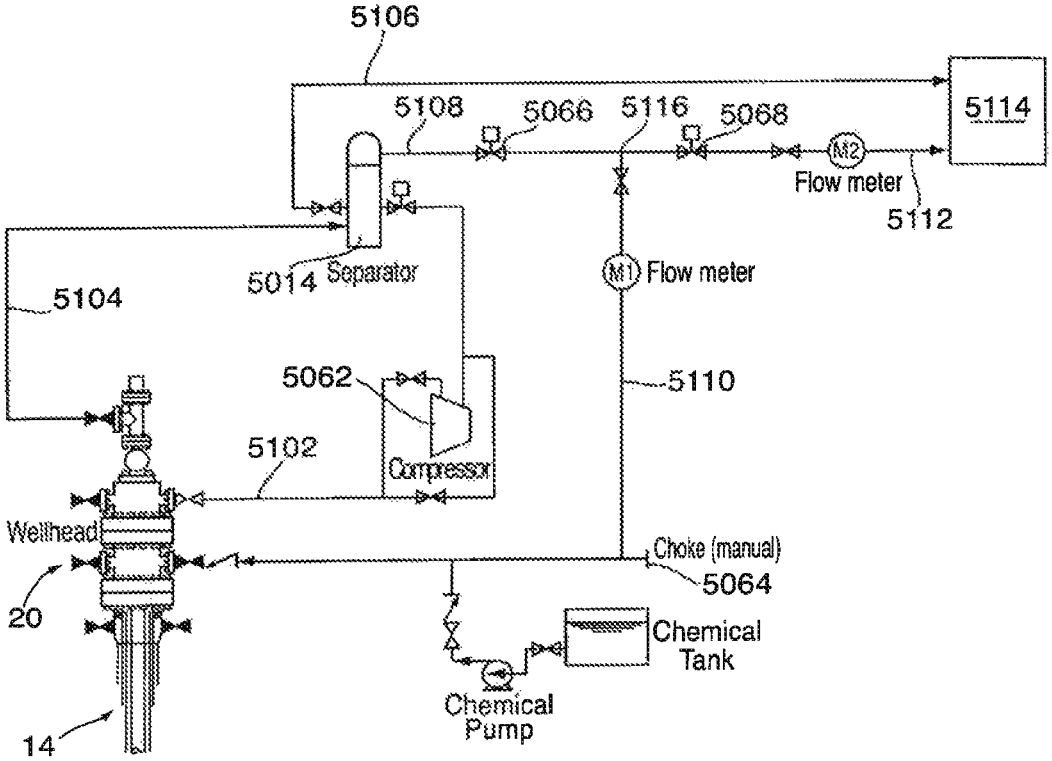
FIG. 17 is a process flow diagram for a surface handling facility of the present disclosure. Like reference symbols in the various drawings indicate like elements.

Referring to FIG. 17, in some embodiments, for example, the system also includes a gas-liquid separator 5014. The gas-liquid separator 5014 functions to effect separation of at least a fraction of the produced formation fluid into a gas-rich separated fluid fraction 5108 and a liquid-rich separated fluid fraction 5106. The gas-liquid separator 5014 is fluidly coupled to the wellhead 20 and is thereby configured to receive the formation fluid fractions 5102, 5104 being discharged above the surface. In some embodiments, for example, the produced formation fluid may be subjected to intermediate processing prior to being supplied to the gas-liquid separator 5014. In some embodiments, for example, the intermediate processing may be effected at a satellite battery, and may include separating of some of the liquid component from the produced formation fluid. In some embodiments, for example, the intermediate processing may include extracting excess gas (such as by flaring off of excess gas) from the produced formation fluids. Even when subjected to intermediate processing, the material resulting from such intermediate processing, and supplied to the gas-liquid separator 5014, is "at least a fraction" of the produced formation fluid.

In some embodiments, for example, the gas-liquid separator 5014 is included with other surface equipment within a multi-well battery. In this respect, in some embodiments, for example, the gas-liquid separator 5014 can be configured to receive formation fluid that is produced from multiple wells, the production from each one of the wells being effected by a respective formation fluid conducting apparatus. The produced formation fluid, from multiple wells, is collected by a manifold that is fluidly coupled to the gas-liquid separator for delivery the produced formation fluid from multiple wells.

In some embodiments, for example, after the separation within the separator 5014, at least a fraction of the liquid-rich separated fluid fraction 5106 is conducted to and collected within storage tanks disposed within the battery. In some embodiments, for example, prior to being collected within the storage tanks, the liquid-rich separated fluid fraction can be further processed, such as, for example, to remove water, and thereby provide a purified form of hydrocarbon product. In some embodiments, for example, prior to being collected within the storage tank, the liquid-rich separated fluid fraction can be further processed, such as, for example, to remove natural gas liquids from the separated gas phase, and thereby provide a purified form of hydrocarbon product. The separated liquid rich material that is collected within the storage tank can be subsequently conducted to a predetermined location using a pipeline, or can be transported by truck or rail car.

In some embodiments, for example, at least a fraction of the gas-rich separated fluid fraction 5108 (produced by the separator 5014) is supplied downhole within the wellbore 18 for admixing with formation fluid that is entering the wellbore 18 to produce the density-reduced formation fluid. In this respect, at least a fraction of the produced gaseous material (of the produced gas-rich formation fluid fraction 5102) is recycled as at least a fraction of a gaseous material input that is being supplied downhole for effecting gas-lift of the formation fluid entering the wellbore 18. In this respect, at least a fraction of the produced gaseous material defines at least a fraction of the gaseous material input 5110. Produced gaseous material defines gaseous material input 5110 when the material of the gaseous material input 5110 is the same material as that of the produced gaseous material, or when the material of the gaseous material input 5110 is derived from the material of the produced gaseous material (such as, for example, when material of the gaseous material input 5110 is material resulting from chemical conversion of material of the produced gaseous material).

In some embodiments, for example, prior to the admixing with the formation fluid, the gaseous material input 5110 (including the recycled produced gaseous material) is conducted through a choke 5064 such that the gaseous material input 5110 becomes disposed in a choked flow condition, and continues to be disposed in the choked flow condition while being conducted into the wellbore 18 for admixing with the formation fluid. In this way, upstream propagation of transient flow conditions within the wellbore 18 is mitigated. In some embodiments, for example, the choke 5064 is an autonomous choke.

In some embodiments, for example, the pressure of the gaseous material input 5110 (including the recycled produced gaseous material), upstream of the choke 5064, is controlled so as to further mitigate the creation of transient flow conditions within the wellbore 18, which could disrupt production. In this respect, in some modes of operation, when the pressure of the gaseous material input 5110, upstream of the choke 5064, deviates from a predetermined pressure, the pressure of the gaseous material input 5110 is modulated. In some embodiments, for example, the modulation of the pressure of the gaseous material input 5110 is effected by at least modulating the volumetric flow rate of the gaseous material input 5110.

In some embodiments, for example, the modulation is effected by a pressure regulator 5066 configured for producing the gaseous material input 5110 having the predetermined pressure. In some embodiments, for example, the system includes the separator 5014, and the pressure regulator 5066 is disposed downstream of the separator 5014 and effects the modulating of the pressure of the gaseous material input 5110 such that the pressure of the gaseous material input 5110 is attenuated to the predetermined pressure. In some embodiments, for example, the pressure regulator 5066 effects modulating of the pressure of the separated gas-rich separated fluid fraction 5108 (and, thereby, the constituent recycled produced gas-rich formation fluid fraction that becomes at least a portion of the gaseous material input 5110) such that the pressure of the gaseous material input 5110 is modulated. In some embodiments, for example, the modulation of the pressure of the separated gas-rich separated fluid fraction 5108 is effected by the pressure regulator 5066 modulating the volumetric flow rate of the separated gas-rich separated fluid fraction 5108 (and, thereby, the recycled produced gas-rich formation fluid fraction). In this respect, the pressure regulator 5066 modulates the volumetric flow rate of the gas-rich separated fluid fraction 5108 (and, thereby, the recycled produced gas-rich formation fluid fraction) such that the pressure of the gas-rich separated fluid fraction 108 is modulated.

In some embodiments, for example, one fraction of the gas-rich separated fluid fraction 5108 may be supplied to the wellbore 18 as at least a fraction of the gaseous material input 5110, and another fraction (a gaseous material bleed 5112) may be supplied to another destination 5114 (i.e. other than the wellbore 18), such as another unit operation or a storage tank, such as for the purpose of sale and distribution to market. In this respect, in some embodiments, for example, the modulating of the pressure of the gaseous material input 5110 includes the combination of modulating of the volumetric flow rate of the gas-rich separated fluid fraction 5108, and modulating of the volumetric flow rate of the gaseous material bleed 5112. In this respect, such modulation, in combination with the choke 5064 is with effect that the gaseous material input 5110 is supplied to the wellbore 18 at a sufficient volumetric flow rate such that the density-reduced formation fluid being conducted uphole, within the wellbore 18, is disposed in a desirable flow regime (such as, for example, the mist flow regime or the annular transition flow regime), and any excess volumetric flow rate of the gas-rich separated fluid fraction 5108, over that required for realizing the sufficient volumetric flow rate of the gaseous material input 5110, is supplied to the another destination 5114. In this respect, in some embodiments, for example, the modulating of the pressure of the gaseous material input 5110 may include one or both of: (i) modulation of the volumetric flow rate of the gas-rich separated fluid fraction 5108, upstream of the division 5116 of the gas-rich separated fluid fraction 5108 into at least a recycled produced gaseous material and a produced gaseous material bleed 5112, and (ii) modulation of the volumetric flow rate of the produced gaseous material bleed 5112. In this respect, the modulation (increase or decrease) of the volumetric flow rate of the gas-rich separated fluid fraction 5108, upstream of the division 5116 of the gas-rich separated fluid fraction 5108 into at least a recycled produced gaseous material and a produced gaseous material bleed 5112, may be effected by a first pressure regulator 5066 configured for producing a gas-rich separated fluid fraction 5108 having a first predetermined pressure. Also in this respect, the modulation (increase, decrease or suspension) of the volumetric flow rate of the produced gaseous material bleed 5112 may be effected by a second pressure regulator 68 configured for producing a produced gaseous material bleed 5112 having a second predetermined pressure. The first predetermined pressure is greater than the second predetermined pressure. For example, the difference between the first predetermined pressure and the second predetermine pressure is at least 5 pounds per square inch, such as, for example, at least 10 pounds per square inch. In some operational modes, for example, the volumetric flow rate of the gas-rich separated fluid fraction 5108 is modulated such that the volumetric flow rate of the recycled produced gaseous material (of the gaseous material input 5110) is such that pressure of the gas-rich separated fluid fraction 5108, disposed intermediate of the first pressure regulator 5066 and the second pressure regulator 5068, is less than the second predetermined pressure, such that the second pressure regulator 5068 remains closed and the entirety of the gas-rich separated fluid fraction 108 is recycled as the gaseous material input 5110. In some operational modes, for example, the volumetric flow rate of the gas-rich separated fluid fraction is modulated such that the volumetric flow rate of the recycled produced gaseous material is such that pressure of the gas-rich separated fluid fraction 5108, disposed intermediate of the first pressure regulator 5066 and the second pressure regulator 5068, is greater than the second predetermined pressure, such that the second pressure regulator 5068 opens and a fraction of the gas-rich separated fluid fraction 5108 is conducted to the another destination 5114.

In another aspect, the process includes modulating a fluid characteristic of the gas-rich separated fluid fraction 5108 such that the density-reduced formation fluid being conducted uphole, within the wellbore 18, is disposed within a predetermined flow regime. In some embodiments, for example, the modulating is effected in response to departure of a fluid characteristic from a predetermined set point. In some of these embodiments, for example, the predetermined set point is based on effecting disposition of the density-reduced formation fluid, being conducted uphole within the wellbore 18, within the predetermined fluid regime. In some embodiments, for example, the fluid characteristic includes a pressure of the gas-rich separated fluid fraction 5108. In some embodiments, for example, the fluid characteristic includes a volumetric flowrate of the gas-rich separated fluid fraction 5108. In some embodiments, for example, the predetermined fluid regime is an annular transition flow regime. In some embodiments, for example, the predetermined fluid regime is a mist flow regime.

In another aspect, the process includes controlling a fluid characteristic of the gas-rich separated fluid fraction 5108 such that the density-reduced formation fluid being conducted uphole, within the wellbore 18, is disposed within a predetermined flow regime. In some embodiments, for example, the fluid characteristic includes a pressure of the gas-rich separated fluid fraction 5108. In some embodiments, for example, the fluid characteristic includes a volumetric flowrate of the gas-rich separated fluid fraction 5108. In some embodiments, for example, the predetermined fluid regime is an annular transition flow regime. In some embodiments, for example, the predetermined fluid regime is a mist flow regime.

In another aspect, the process includes controlling a fluid characteristic of the gas-rich separated fluid fraction 5108 such that the derivative of the bottomhole pressure with respect to the volumetric flow of the gaseous material input 5110, being supplied to the wellbore 18 and admixed with the received reservoir fluid, is greater than zero (0), such as, for example, at least 2 kPa per 1000 cubic metres of gaseous material input per day, such as, for example, at least 5 kPa per 1000 cubic metres of gaseous material input per day, such as, for example, at least 10 kPa per 1000 cubic metres of gaseous material input per day, such as, for example, at least 25 kPa per 1000 cubic metres of gaseous material input per day, such as, for example, at least 50 kPa per 1000 cubic metres of gaseous material input per day. In some embodiments, for example, the fluid characteristic includes a pressure of the gas-rich separated fluid fraction 5108. In some embodiments, for example, the fluid characteristic includes a volumetric flowrate of the gas-rich separated fluid fraction 5108. In some embodiments, for example, the fluid characteristic includes a pressure of the gas-rich separated fluid fraction 5108.

In some embodiments, for example, the downhole gas conducting passage 177 is disposed within the downhole fluid conductor 150, along with the downhole reservoir fluid-conducting passage 154. In this respect, the downhole fluid conductor 150 includes the downhole gas conducting passage 177 and the downhole reservoir fluid-conducting passage 154. In some of these embodiments, for example, the downhole fluid conductor 150 includes the downhole gaseous fluid conductor 176, including the downhole gas conducting passage 177, and a downhole reservoir fluid conductor 190, including the downhole reservoir fluid-conducting passage 154, and the downhole reservoir fluid conductor 190 is nested within the downhole gaseous fluid conductor 176, such that the downhole gas conducting passage 177 is defined by an intermediate passage (such as an annulus) between the downhole gaseous fluid conductor 176 and the downhole reservoir fluid conductor 190.

In another aspect, the space, between: (a) the second inlet port 120 of the separator 108, and (b) the sealed interface (such as of sealed interface 300, 302, 304, or 306), defines a sump 206 for collection of solid particulate that is entrained within fluid being discharged from the first outlet port 116 of the separator 108, and the sump 206 has a volume of at least 0.1 m.sup.3. In some embodiments, for example, the volume is at least 0.5 m.sup.3. In some embodiments, for example, the volume is at least 1.0 m.sup.3. In some embodiments, for example, the volume is at least 3.0 m.sup.3.

In a related aspect, the space, between: (a) the second inlet port 120 of the separator 108, and (b) the sealed interface (such as sealed interface 300, 302, 304, or 306), defines a sump 206 for collection of solid particulate that is entrained within fluid being discharged from the first outlet port 116 of the separator 108, and the minimum separation distance between: (a) the second inlet port 120 of the separator 108, and (b) the sealed interface (such as sealed interface 300, 302, 304. or 306), measured along a line parallel to the axis of the fluid passage of the wellbore fluid conductor 100, is at least 30 feet, is at least 30 feet. In some embodiments, for example, the minimum separation distance is at least 45 feet. In some embodiments, for example, the minimum separation distance is at least 60 feet.

Figure 16:
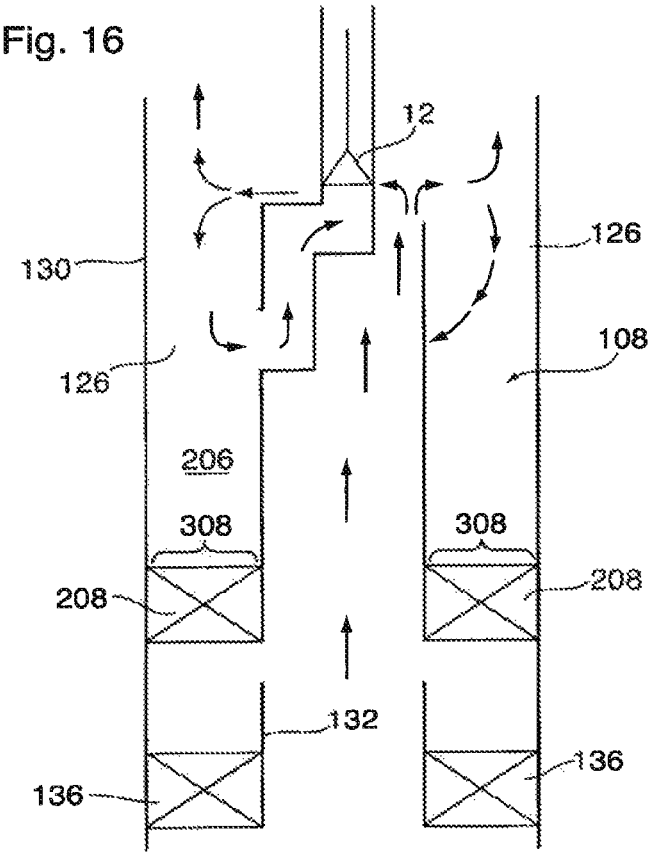
FIG. 16 is a schematic illustration of another embodiment of a system of the present disclosure using a downhole pump.

Referring to FIG. 16, in some of these embodiments, for example, the wellbore fluid conductor 100 includes the wellbore casing 130, and the wellbore casing 130 includes the co-operating fluid conductor 106, and the sealing, or substantially sealing, disposition of the separator 108 relative to the co-operating fluid conductor 106 is effected by at least a packer 208 disposed between the separator 108 and the wellbore casing 130. The sealing, or substantially sealing, disposition of the separator 108 relative to the co-operating fluid conductor 106 that is effected by at least a packer 208, defines the above-described sealed interface (as sealed interface 308) In some of these embodiments, for example, the packer 208 is carried by the separator 108. In some of these embodiments, for example, the packer 208 is disposed downhole relative to the second inlet port 120. In some of these embodiments, for example, the wellbore fluid conductor further includes a liner 132, the liner 132 being connected or coupled to (such as, for example, by being hung from the wellbore casing 130), and being disposed in sealing, or substantially sealing, engagement with the wellbore casing 130. The liner 132 includes a liner fluid passage 134, such that the downhole wellbore fluid conductor fluid passage 112 includes the liner fluid passage 112, and such that the first inlet port 114 is disposed for receiving at least reservoir fluids via the liner fluid passage 134. In some of these embodiments, for example, the sealing, or substantially sealing, engagement between the liner and the wellbore casing is with effect that fluid flow, at least in a downhole direction, is prevented or substantially prevented at the sealing engagement. In some of these embodiments, for example, the sealing, or substantially sealing, engagement between the liner 132 and the wellbore casing 130 is effected by a packer 136 disposed between the liner 132 and the wellbore casing 130.

Referring to FIG. 1, in some of these embodiments, for example, the liner 132 is connected or coupled to (such as, for example, being hung from) the co-operating fluid conductor 106 and disposed in sealing, or substantially sealing, engagement with the co-operating fluid conductor 106, and including a liner fluid passage 134, such that the downhole wellbore fluid passage 112 includes the liner fluid passage 134. The separator 108 is disposed in sealing, or substantially sealing engagement with the liner 132. As discussed above, the sealing, or substantially sealing, disposition of the separator 108 relative to the co-operating fluid conductor 106 is effected by at least: (a) the sealing, or substantially sealing, engagement of the liner 132 with the co-operating fluid conductor 106, and (b) the sealing, or substantially sealing, engagement of the separator 108 with the liner 132. The first inlet port 114 is disposed for receiving at least reservoir fluid via the liner fluid passage 134. In some embodiments, for example, the separator 108 further includes a latch seal assembly 200 releasably coupled to the liner 132, wherein the sealing, or substantially sealing, engagement between the liner 132 and the separator 108 is effected by the latch seal assembly 200. In some embodiments, for example, the sealing, or substantially sealing, engagement between the liner 132 and the co-operating fluid conductor 106 is effected by a packer 136 disposed between the liner 132 and the co-operating fluid conductor 106.

Referring to FIG. 8, in some of these embodiments, for example, and as discussed above, the co-operating fluid conductor 106 includes a constricted portion 138, and the separator 108 is disposed in sealing, or substantially sealing, engagement with the constricted portion 138, such that the sealing, or substantially sealing, disposition of the separator 108 relative to the co-operating fluid conductor 106 is effected by at least the sealing, or substantially sealing, engagement of the separator 108 with the constricted portion 138. In some embodiments, for example, the sealing, or substantially sealing, engagement between the separator 108 and the constricted portion 136 is effected by at least a sealing member 202 that is carried by the separator 108. In some embodiments, for example, the separator 108 is disposed in an interference fit relationship with the constricted portion 138.

By providing for a sump 206 having the above-described volumetric space characteristic, and/or the above-described minimum separation distance characteristic, a suitable space is provided for collecting relative large volumes of solid debris, such that interference by the accumulated solid debris with the production of oil through the system is mitigated. This increases the run-time of the system before any maintenance is required. As well, because the solid debris is deposited over a larger area, the propensity for the collected solid debris to interfere with movement of the separator 108 relative to the co-operating fluid conductor 106, such as during maintenance (for example, a workover) is reduced.

Referring to FIGS. 1, 8, 10 and 11, in some embodiments, for example, the sealed interface is disposed within a section of the wellbore whose axis 14A is disposed at an angle ".alpha." of at least 60 degrees relative to the vertical "V". In some of these embodiments, for example, the sealed interface is disposed within a section of the wellbore whose axis 14A is disposed at an angle ".alpha." of at least 85 degrees relative to the vertical "V". In this respect, disposing the sealed interface within a wellbore section having such wellbore inclinations minimizes solid debris accumulation on the sealed interface.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety. A number of embodiments of the invention have been described. Nevertheless, it will be understood that various modifications may be made without departing from the spirit and scope of the invention.

What is claimed is:

1. A system for processing at least reservoir fluids within a wellbore that is disposed within an oil reservoir, the system comprising:

a separator co-operating fluid conductor disposed within the wellbore, and including a downhole wellbore fluid passage for receiving reservoir fluids from the reservoir and for conducting at least reservoir fluids;

a separator comprising:

a housing;

a first inlet port defined by the housing and disposed in fluid communication with the downhole wellbore fluid passage for receiving at least reservoir fluids from the downhole wellbore fluid passage;

a first outlet port defined by the housing;

a reservoir fluid-conducting passage extending between the first inlet port and the first outlet port;

a second inlet port defined by the housing and disposed downhole relative to the first outlet port;

a second outlet port defined by the housing;

a gas-depleted fluid conducting passage extending between the second inlet port and the second outlet port; and a co-operating surface portion co-operating with the separator co-operating fluid conductor to define an intermediate fluid passage therebetween for effecting fluid communication between the first outlet port and the second inlet port; and a sealed interface, defined by a sealingly, or substantially sealingly, disposition of the separator relative to the separator co-operating fluid conductor, wherein the sealing disposition is effected downhole relative to the second inlet port, with effect that fluid flow, across the sealed interface, is prevented, or substantially prevented;

wherein the sealed interface is disposed within a wellbore section having a longitudinal axis that is disposed at an angle of at least 60 degrees, relative to a vertical, and distal relative to the surface.

2. The system as claimed in claim 1;

wherein a space, between: (a) the second inlet port of the separator, and (b) the sealed interface, defines a sump for collection of solid particulate that is entrained within fluid being discharged from the first outlet port of the separator.

3. The system as claimed in claim 2;

wherein the space has a volume of at least 0.1 cubic meters ($m^3$).

4. The system as claimed in claim 2;

wherein the minimum separation distance between: (a) the second inlet port of the separator, and (b) the sealed interface, measured along a line parallel to the longitudinal axis of the fluid passage of the separator co-operating fluid conductor, is at least 30 feet.

* * * * *